US006907902B2

(12) United States Patent
Kaneda et al.

(10) Patent No.: US 6,907,902 B2
(45) Date of Patent: Jun. 21, 2005

(54) HYDRAULIC SIGNAL OUTPUT DEVICE

(75) Inventors: Tomohisa Kaneda, Mooka (JP); Shuuji Hori, Oyama (JP); Naoki Ishizaki, Tochigi (JP); Yasuhiro Satou, Oyama (JP); Masayoshi Mototani, Oyama (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 10/287,615

(22) Filed: Nov. 5, 2002

(65) Prior Publication Data

US 2003/0084782 A1 May 8, 2003

(30) Foreign Application Priority Data

Nov. 8, 2001 (JP) ..... 2001-343478

(51) Int. Cl.[7] ..... F15B 13/043
(52) U.S. Cl. ..... 137/636.2; 137/596.1
(58) Field of Search ..... 137/596.1, 636.1, 137/636.2, 596.2

(56) References Cited

U.S. PATENT DOCUMENTS 5,295,513 A * 3/1994 Hori ..... 137/636.2
6,655,229 B2 * 12/2003 Yamamoto et al. ..... 137/636.2

FOREIGN PATENT DOCUMENTS

JP 3178556 B2 6/1994
JP 2925895 B2 3/1995

* cited by examiner

*Primary Examiner*—Gerald A. Michalsky
(74) *Attorney, Agent, or Firm*—Varndell & Varndell, PLLC

(57) ABSTRACT

The present invention intends to provide a hydraulic signal output device having a smaller installation space, and thereby enabling to make an installation space of hydraulic machines in an operation room smaller and that of other than the hydraulic machines larger. In addition to this, the present invention intends to allow externally restricting an operation in the operation room. In order to attain the intentions, in a hydraulic signal output device of the present invention, a PPC valve, an EPC valve and a shuttle valve are integrally formed. In one invention, in addition to the above, a pressure oil output port in a pressure-reducing valve in the PPC valve is communicated with a pressure oil input port of a switching valve in an electromagnetic valve, and a pressure oil output port of the switching valve in the electromagnetic valve is communicated with a pilot pipe line.

12 Claims, 21 Drawing Sheets

HYDRAULIC SIGNAL OUTPUT DEVICE

BACKGROUND OF THE INVENTION

1. Field of the Invention

The present invention relates to a hydraulic signal output device that outputs a hydraulic signal in accordance with a manual operation to an external actuator.

2. Description of the Related Art

An operation room of a hydraulic shovel is provided with a pilot pressure oil output device that outputs pilot pressure oil in accordance with an operation of such as an operation lever. When an operator tilts the operation lever fore and aft, from side to side, and obliquely, a movement of a vehicle can be controlled.

FIG. 20 shows an operator's seat 100 disposed in an operation room. Sideward to the operator's seat 100, a lever stand 80 is disposed. The lever stand 80 is provided with a hydraulic signal output device constituted of a PPC valve. An operation lever 7 is attached to the hydraulic signal output device and disposed so as to project upward from the lever stand 80. FIGS. 21A through 21C are a side view, a plan view and a bottom view, respectively, of a hydraulic signal output device 50 to which the operation lever 7 is attached, and as shown in these drawings the hydraulic signal output device 50 is accommodated in the lever stand 80.

FIG. 12 is a sectional view of a hydraulic signal output device having an operation lever. In the hydraulic signal output device 50, when a single operation lever is tilted, each of four pistons outputs outside a hydraulic signal in accordance with its displacement, specifically pilot pressure oil is outputted. When the operation lever is tilted, the pilot pressure oil is outputted, the outputted pilot pressure oil is guided to a not shown operation valve, and thereby an operation valve is operated. When the operation valve is controlled, a hydraulic motor that makes a vehicle run or a hydraulic cylinder that operates an operating machine is controlled in their movement. The hydraulic signal output device 50 is called a PPC valve.

Furthermore, in some cases, a hydraulic signal output device that outputs pilot pressure oil in accordance with an electrical signal is disposed. When an operation is carried out in, for instance, a dangerous spot, it is dangerous for an operator to ride and operates a vehicle. In such a case, an operator operates a remote control device externally of the operation room and sends a radio signal to the hydraulic signal output device. Based on the received signal, a current flows in the hydraulic signal output device, and the pilot pressure oil in accordance with a magnitude of the signal is outputted.

FIG. 13 is a sectional view of a hydraulic signal output device that outputs pilot pressure oil in accordance with an electrical signal. A hydraulic signal output device 60 outputs pilot pressure oil in accordance with a thrust force of a plunger 26. The hydraulic signal output device 60 is disposed corresponding to each of pistons of the hydraulic signal output device 50. Accordingly, when the hydraulic signal output device 60 is remote-controlled, a movement of a hydraulic motor that makes a vehicle run is controlled. The hydraulic signal output device 60 is called a proportional EPC valve, and a thrust force that is proportional to a magnitude of a current that flows in a solenoid coil 25 acts in an arrow mark U direction.

As shown in FIG. 14, in the case of the PPC valve 50 and the EPC valve 60 being provided to an operation room of a vehicle, a shuttle valve 30 that connects the PPC valve 50 and the EPC valve 60 is disposed.

The shuttle valve 30 outputs the pilot pressure oil of a higher-pressure one of the PPC valve 50 and the EPC valve 60. The pilot pressure oil is input into an operation valve that controls pressure oil that is supplied to the hydraulic motor. Accordingly, when the operator operates the operation lever or the remote-control device, a vehicle is made run or the operating machine is made to operate.

However, when the PPC valve 50, the EPC valve 60 and the shuttle valve 30 are disposed separately in the operation room, there is necessity of connecting between these PPC valve 50, EPC valve 60 and shuttle valve 30 through a pipe line such as a hose and so on, resulting in a large installation space. Accordingly, there is a problem in that a space other than the hydraulic machines in the operation room becomes relatively smaller.

The present invention is carried out in view of such situations and a first object of the present invention is to provide a hydraulic signal output device having a smaller installation space, and thereby making the installation space of the hydraulic machines in the operation room relatively smaller and thereby making a space other than the hydraulic machines relatively larger.

In some cases, however, the operator may manually operate wrongly and allow the vehicle to intrude into a dangerous spot. In this case, the operator is mostly not aware of the vehicle having intruded into the dangerous spot. At the time of such wrong operation being performed, unless some measures are not applied from the outside, the vehicle is allowed to intrude into a further dangerous spot.

Furthermore, in some cases, an operator unfamiliar to the operation of the PPC valve 50 may not move the vehicle as he wants.

The present invention is carried out in view of these situations, and a second object of the present invention is to allow externally limiting the operation in the operation room.

Actually, a shape of the lever stand 80 shown in FIG. 20 can be various because of the restrictions resulting from a layout of the operation room. Accordingly, depending on the shape of the lever stand 80, different from one that is shown in FIG. 21, the hydraulic signal output device 50 may not be accommodated inside of the lever stand 80.

The present invention is carried out in view of such situations and a third object of the present invention is to allow the lever stand 80, irrespective of the shape thereof, to accommodate the hydraulic signal output device therein.

SUMMARY OF THE INVENTION

In order to attain the first object, according to a first invention, a hydraulic signal output device includes:

manual hydraulic signal output means (50) for outputting a hydraulic signal based on a manual operation;

electrical hydraulic signal output means (60) for outputting a hydraulic signal based on an electrical signal; and selection output means (30) for selecting and externally outputting either one of the hydraulic signal outputted from the manual hydraulic signal output means (50) or the hydraulic signal outputted from the electrical hydraulic signal output means (60);

wherein the manual hydraulic signal output means (50), the electrical hydraulic signal output means (60) and the selection output means (30) are integrally formed.

According to the first invention, a PPC valve 50, an EPC valve 60 and a shuttle valve 30 are integrally formed.

Accordingly, there is no need of connecting the PPC valve 50, the EPC valve 60 and the shuttle valve 30 through a pipe line such as a hose, resulting in a smaller installation space of the hydraulic machines in the operation room. As a result, a larger installation space for other than the hydraulic machines in the operation room can be secured.

In order to attain the second object, according to a second invention, a hydraulic signal output device provided with manual hydraulic signal output means (50) that manually output a hydraulic signal from a signal output port **(15*b*) and externally output it through a pipe line (19)** includes:

an electromagnetic valve (70) in which a hydraulic signal is inputted and an oil passage is opened/closed according to an electrical signal generated by a remote-operation;

wherein the signal output port **(15*b*) and an inlet (71*b*) of the electromagnetic valve (70) are connected and an outlet (71*c*) of the electromagnetic valve (70) is connected to the pipe line (19); and the electromagnetic valve (70) is opened to externally output a hydraulic signal outputted from the signal output port (15*b*) through the pipe line (19), and in accordance with a communication release instruction due to the remote-control the electromagnetic valve (70) is closed to cut off the hydraulic signal outputted from the signal output port (15*b*) with the electromagnetic valve (70)**.

The second invention will be explained with reference to FIGS. 5 and 6.

FIGS. 5 and 6 show a state where a current does not flow in a solenoid coil 25. In this state, a pressure oil output port **15*b* of the PPC valve 50 and a pilot pipe line 19 are communicated through the electromagnetic valve (70), specifically a pressure oil input port 71*b*, a notch 72*a* and a pressure oil output port 71*c*. Accordingly, pilot pressure oil generated by tilting the operation lever 7 is outputted from the pressure oil output port 15*b* through the pressure oil input port 71*b*, the notch 72*a* and the pressure oil output port 71*c* to the pilot pipe line 19**.

In accordance with an operation of an operation part 35 outside a vehicle, an energization instruction is radio transmitted. The energization instruction is received at a receiving part 36 inside the vehicle. A controller 37, based on the energization instruction received at the receiving part 36, controls a current flowing in the solenoid coil 25. When the current flows in the solenoid coil 25, a thrust force is applied on a plunger 26 and the plunger 26 is moved to an arrow mark U direction, that is, toward a spool 72. As the plunger 26 moves, the spool 72 moves to an arrow mark U direction, that is, toward a pressure-reducing valve 14. As the spool 72 moves, the communication between the pressure oil input port **71*b* and the notch 72*a* of the spool 72 is cut off. That is, the pressure oil output port 15*b* of the pressure-reducing valve 14 is cut off the pilot pipe line 19 with the electromagnetic valve 70**.

According to the second invention, by externally operating the operation part 35, the operation in the operation room of the vehicle can be limited.

Furthermore, in a third invention, a hydraulic signal output device is one that is set forth in the second invention:

wherein the manual hydraulic signal output means (50) and the electromagnetic valve (70) are integrally formed.

According to the third invention, the PPC valve 50 and the electromagnetic valve 70 are integrally formed. Accordingly, there is no need of connecting the PPC valve 50 and the electromagnetic valve 70 through a pipe line such as a hose. As a result, an installation space of the hydraulic machines in the operation room can be made smaller.

As a result, a larger space for other than the hydraulic machines in the operation room can be secured.

In order to attain the second object, according to a fourth invention, a hydraulic signal output device provided with manual hydraulic signal output means (50) that manually output a hydraulic signal from a signal output port **(15*b*) and outputs it though a pipe line (19)** outside thereof includes:

electrical hydraulic signal output means (80) in which a hydraulic signal is inputted, converted into a hydraulic signal in accordance with an electrical signal generated by the remote-operation, and outputted;

wherein the signal output port **(15*b*) and an inlet (27*b*) of the electrical hydraulic signal output means (80) are connected, and an outlet (27*d*) of the electrical hydraulic signal output means (80) is connected to the pipe line (19); and the electrical hydraulic signal output means (80) are operated in accordance with a hydraulic signal change instruction due to the remote-operation to modify a hydraulic signal outputted from the signal output port (15*b*) and to externally output the modified signal through the pipe line (19)**.

The fourth invention will be explained with reference to FIGS. 9 and 10.

FIGS. 9 and 10 show a state where a current does not flow in a solenoid coil 25. In this state, a pressure oil output port **15*b* of the PPC valve 50 and a pilot pipe line 19 are communicated through the EPC valve (80), specifically a pressure oil input port 27*b*, a notch 28*a*, a gap 27*c* and a pressure oil output port 27*d*. Accordingly, pilot pressure oil generated by tilting the operation lever 7 is outputted from the pressure oil output port 15*b* through the pressure oil input port 27*b*, the notch 28*a* and the pressure oil output port 27*d* to the pilot pipe line 19**.

In accordance with an operation of an operation part 35 outside the vehicle, an energization instruction is radio transmitted. The energization instruction is received at a receiving part 36 inside the vehicle. A control part 37, based on the energization instruction received at the receiving part 36, controls a current flowing in the solenoid coil 25. When the current flows in the solenoid coil 25, a thrust force is applied on a plunger 26 in an arrow mark D direction, that is, toward a spring 38 side. As the plunger 26 moves, a spool 28 moves to an arrow mark D direction, that is, toward the plunger 26 side. At a position where a thrust force toward the spring 38 side acting on the plunger 26 establishes a balance with a spring force of the spring 38 and a pressure of pilot pressure oil acting on the spool 28, the spool 28 ceases moving.

According to the fourth invention, by externally operating the operation part 35, the operation in the operation room of the vehicle can be limited.

Furthermore, in a fifth invention, a hydraulic signal output device is one that is set forth in the fourth invention:

wherein the manual hydraulic signal output means (50) and the electrical hydraulic signal output means (80) are integrally formed.

According to the fifth invention, the PPC valve 50 and the EPC valve 80 are integrally formed. Accordingly, there is no need of connecting the PPC valve 50 and the EPC valve 80 through a pipe line such as a hose. As a result, an installation space of the hydraulic machines in the operation room can be made smaller.

Accordingly, in the operation room, a larger space for other than the hydraulic machines can be secured.

In order to attain the third object, a hydraulic signal output device according to a sixth invention includes:

a manual part (50) that has a manual spool that is manually operated and outputs a hydraulic signal in accordance with the operation of the manual spool; and a motorized part (60) that has a motorized shaft that is operated by an electrical signal and outputs a hydraulic signal in accordance with the operation of the motorized shaft;

wherein the motorized part (60) is disposed below the manual part (50) so that the manual spool and the motorized shaft may be in parallel; and the manual part (50) and the motorized part (60) are integrally formed.

According to the sixth invention, as shown in FIG. 15A, the manual part 50 as a PPC valve is attached to a top surface of a top plate 111 of a block 110 so that the internal manual spool may slide in an up and down direction. On the other hand, an electromagnetic solenoid 61 that constitutes the motorized part 60 is attached to a bottom surface of a bottom plate 112 of the block 110 so that the internal motorized shaft (the plunger 26 in FIG. 1) may slide in an up and down direction. Thus, the motorized part 60 is disposed below the manual part 50 so that the manual spool and the motorized shaft may be in parallel, and the manual part 50 and the motorized part 60 are integrally formed.

According to the sixth invention, since the manual part 50 and the motorized part (60) are integrally formed along an up and down direction so that the manual spool and the motorized shaft may be in parallel, a hydraulic signal output device 90 itself can be formed longer in an up and down direction and shorter in a lateral direction. Accordingly, even when the lever stand 80 is small in width, the hydraulic signal output device 90 can be accommodated inside of the lever stand 80.

In a seventh invention, a hydraulic signal output device is one that is set forth in the sixth invention:

wherein, to a block (110) of the hydraulic signal output device, an output port (115) that externally outputs a hydraulic signal is disposed, and an operation valve that is operated in accordance with a hydraulic signal that is outputted from the output port (115) is disposed; and of the respective positions of the block (110), on a side that faces a position where the operation valve is disposed, the output port (115) is disposed.

According to the seventh invention, as shown in FIGS. 15A and 15C, behind the block 110 of the hydraulic signal output device 90 where the manual part 50 and the motorized part 60 are integrally formed, an operation valve is disposed, and behind a lower portion of the block 110, that is, on an operation valve side of the various positions of the block 110, the output port 115 that outputs a hydraulic signal is disposed. The output port 115 and the operation valve are connected with a pipe line 19. Thus, of various positions of the block 110 of the hydraulic signal output device 90, on a side that faces a position where the operation valve is disposed, the output port 115 is disposed.

According to the seventh invention, since the output port 115 is disposed on a side that faces a position where the operation valve of the block 110 is disposed, the output port 115 is connected at the shortest distance to the operation valve and there is no need of avoiding an obstacle such as the EPC valve 60, and an easy configuration of the pipe line such as routing of the pipe line 19 results.

Furthermore, in an eighth invention, a hydraulic signal output device is one that is set forth in the sixth invention:

wherein the motorized part (60) includes a plurality of electromagnetic valves (60); and a stand (80) for accommodating the motorized part (60) is provided;

wherein the plurality of electromagnetic valves (60) are arranged so that a direction of arrangement of the plurality of electromagnetic valves (60) may be in parallel with an internal wall surface of the stand (80).

According to the eighth invention, as shown in FIG. 15C, since four EPC valves 60 (motorized part) are arranged in parallel with the internal wall surface of the lever stand 80, even when the lever stand 80 is small in a lateral width, the hydraulic signal output device 90 can be accommodated inside the lever stand 80.

Furthermore, in a ninth invention, a hydraulic signal output device is one that is set forth in the sixth invention:

wherein the motorized part (60) includes a plurality of electromagnetic valves (60);

wherein when the electromagnetic valves (60) are fixed to the block 110 of the hydraulic signal output device by use of a plurality of bolts (65*a*, 65*b*), at least one bolt (65*b*) is disposed on an axis (L) along a diameter direction of the electromagnetic valve (60) and a remaining one (65*a*) is disposed a little bit off-set from the axis (L).

According to the ninth invention, at the time of the EPC valve 60 being fixed to the block 110 of the hydraulic signal output device 90 by use of a plurality of bolts 65*a* and 65*b* (FIG. 15C), as shown in FIG. 16, at least one bolt 65*b* is disposed on an axis L along a diameter direction of the EPC valve 60 and a remaining one 65*a* is disposed a little bit off-set from the axis L. Accordingly, a bolt 113 used to attach to the block 110 and the bolt 65*a* are inhibited from interfering each other.

Furthermore, in order to attain the third object, a hydraulic signal output device according to a tenth invention includes:

a manual part (50) that has a manual spool that is manually operated and outputs a hydraulic signal in accordance with the operation of the manual spool; and a motorized part (60) that has a motorized shaft that is operated by an electrical signal and outputs a hydraulic signal in accordance with the operation of the motorized shaft;

wherein the motorized part (60) is partially or entirely disposed at a height substantially equal to the manual part (50) so that the manual spool and the motorized shaft may be in parallel; and the manual part (50) and the motorized part (60) are integrally formed.

According to the tenth invention, as shown in FIGS. 18A and 18B, the manual part 50 as a PPC valve is attached to a top surface of a top plate 111 of the block 110 so that the manual spool in the manual part may slide in an up and down direction. On the other hand, an electromagnetic solenoid 61 that constitutes the motorized part 60 as the EPC valve is attached to a top surface of a top plate 111 of the block 110 so that the motorized shaft in the electromagnetic solenoid (the plunger 26 in FIG. 1) may slide in an up and down direction. Thus, the motorized part 60 (electromagnetic solenoid 61) is partially disposed at a height substantially same as the manual part 50 so that the manual spool and the motorized shaft may be in parallel, and the manual part 50 and the motorized part 60 are integrally formed. An entirety of the motorized part 60 (the electromagnetic solenoid 61 and the pressure-reducing valve 27 in FIG. 1) may be disposed at a height substantially same as the manual part 50.

According to the tenth invention, since the motorized part 60 is partially or entirely disposed at a height substantially same as the manual part 50 so that the manual spool and the motorized spool may be in parallel and the manual part 50 and the motorized part 60 are integrally formed, a hydraulic signal output device 92 itself can be formed shorter in an up and down direction. Accordingly, even when the lever stand 80 is lower in height, the hydraulic signal output device 92 can be accommodated inside of the lever stand 80.

In order to attain the third object, a hydraulic signal output device according to an eleventh invention includes:

a manual part (50) that has a manual spool that is operated manually and outputs a hydraulic signal in accordance with the operation of the manual spool; and a motorized part (60) that has a motorized shaft that is operated by an electrical signal and outputs a hydraulic signal in accordance with the operation of the motorized shaft;

wherein the manual part (50) and the motorized part (60) are integrally formed so that the motorized shaft may be vertical with respect to the manual spool.

According to the eleventh invention, as shown in FIGS. 19A and 19B, the manual part 50 as a PPC valve is attached to a top surface of a top plate 111 of a block 110 so that the manual spool in the manual part may slide in an up and down direction. On the other hand, an electromagnetic solenoid 61 that constitutes the motorized part 60 as an EPC valve is attached to side surfaces of side plates 116 and 117 of the block 110 so that the motorized shaft in the electromagnetic valve (the plunger 26 in FIG. 1) may slide in a lateral direction. Thus, the manual part 50 and the motorized part 60 are integrally formed so that the manual shaft may be vertical with respect to the manual spool.

According to the eleventh invention, since the manual part 50 and the motorized part (60) are integrally formed so that the motorized shaft may be vertical with respect to the manual spool, a hydraulic signal output device 93 can be expanded in width and shortened in an up and down direction. Accordingly, within the lever stand 80 that is low in height and has a room in width, the hydraulic signal output device 93 can be accommodated.

A hydraulic signal output device according to a twelfth invention is one that is set forth in the tenth invention:

wherein the motorized part (60) has an electromagnetic solenoid (61), and the motorized shaft is a plunger (26) of the electromagnetic solenoid (61);

wherein the electromagnetic solenoid (61) is disposed at a height substantially same as the manual part (50) so that the manual spool and the motorized shaft may be in parallel with each other.

According to the twelfth invention, as shown in FIG. 18A, the electromagnetic solenoid 61 that is part of the motorized part 60 is disposed at a height substantially same as the manual part 50.

A hydraulic signal output device according to a thirteenth invention is one that is set forth in the eleventh invention:

wherein the motorized part (60) has an electromagnetic solenoid (61), and the motorized shaft is a plunger (26) of the electromagnetic solenoid (61);

wherein the electromagnetic solenoid (61) is disposed sideward with respect to the manual part (50) so that the motorized shaft may be vertical with respect to the manual spool.

According to the thirteenth invention, as shown in FIG. 19A, the electromagnetic solenoid 61 that is part of the motorized part 60 is disposed sideward with respect to the manual part 50.

DESCRIPTION OF THE PREFERRED EMBODIMENTS

In the following, embodiments of a hydraulic signal output device according to the present invention will be explained with reference to the drawings.

Figure 1:
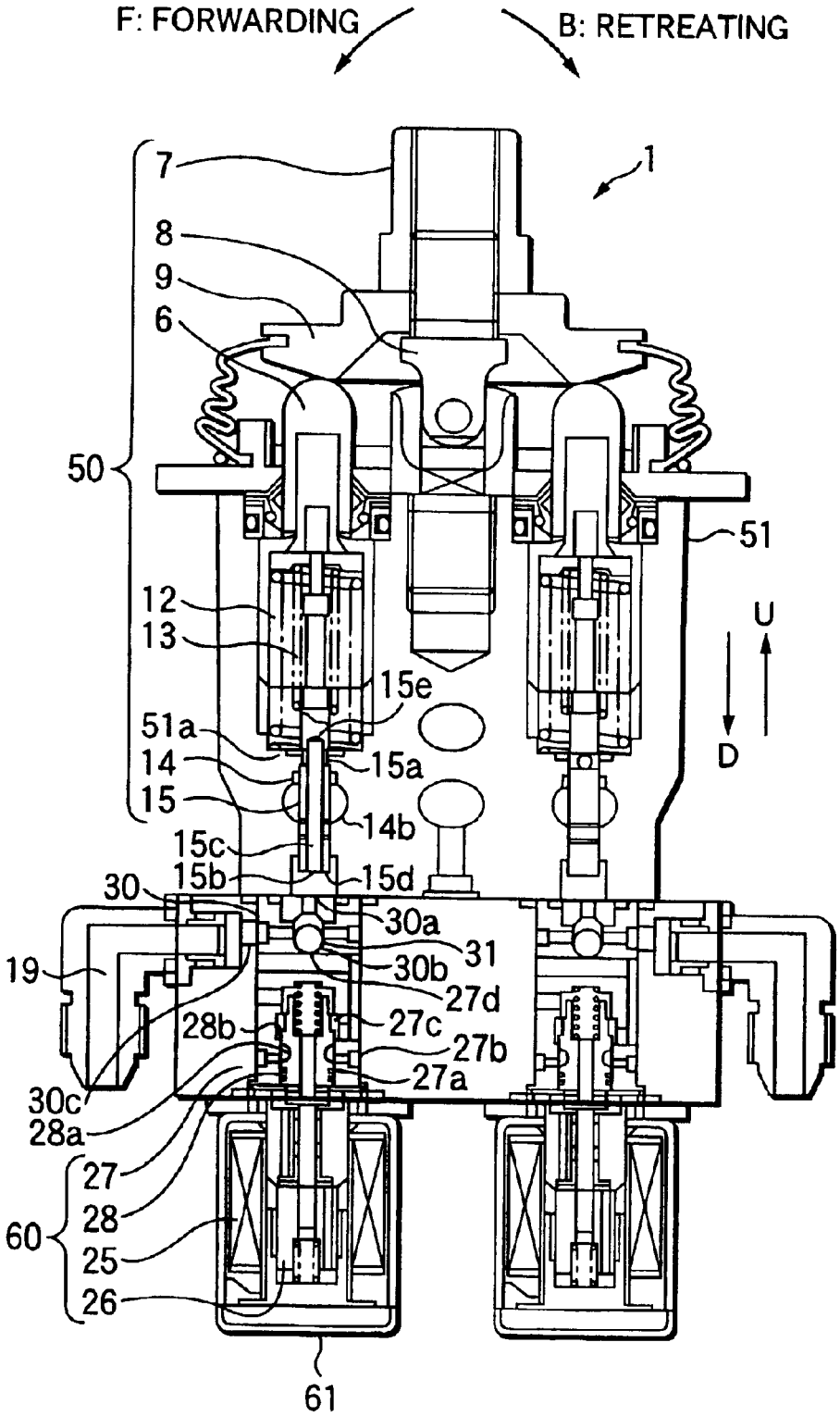
FIG. 1 is a sectional view showing a first embodiment of the present invention.
Figure 2:
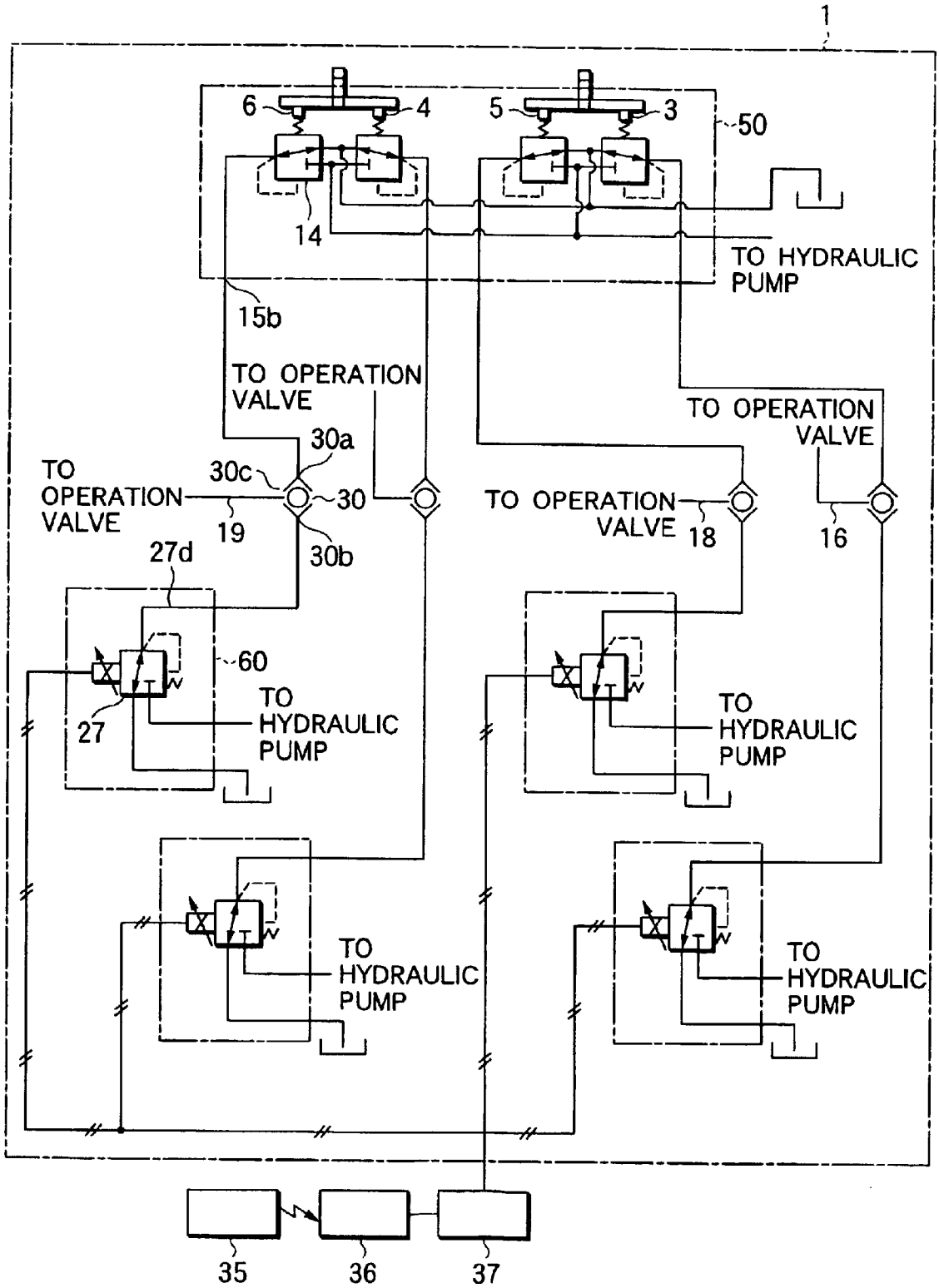
FIG. 2 is a diagram showing an oil pressure circuit of the first embodiment.
Figure 11A:
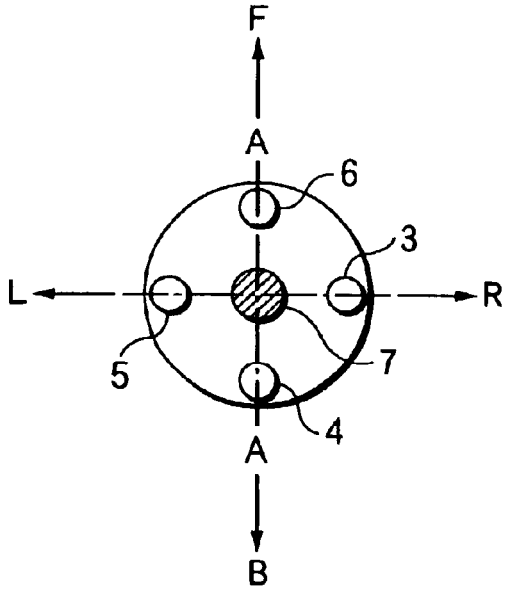
FIGS. 11A and 11B are diagrams for explaining a bi-axial pilot valve.
Figure 11B:
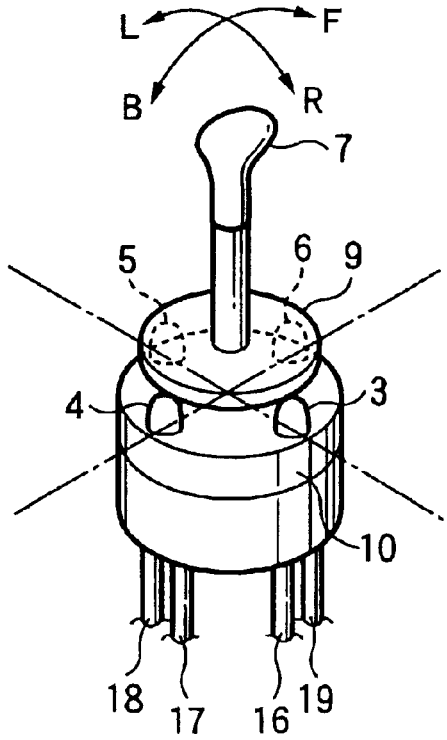

FIG. 1 is a sectional view showing a first embodiment of the present invention. FIG. 2 is a diagram showing an oil pressure circuit of the first embodiment. Furthermore, FIGS. 11A and 11B are diagrams showing movement of an operation lever in a two axis pilot valve. FIG. 1 is a drawing of an A—A section of FIG. 11A seen from left. The explanation will be given with reference to all these drawings.

A configuration of a hydraulic signal output device 1 will be explained.

The hydraulic signal output device 1 shown in FIG. 1 largely includes a PPC valve 50, an EPC valve 60 and a shuttle valve 30, the oil pressure machines 30, 50 and 60 being integrated into one body. The PPC valve 50 and the EPC valve 60 are connected with the shuttle valve 30 interposed therebetween.

Figure 12:
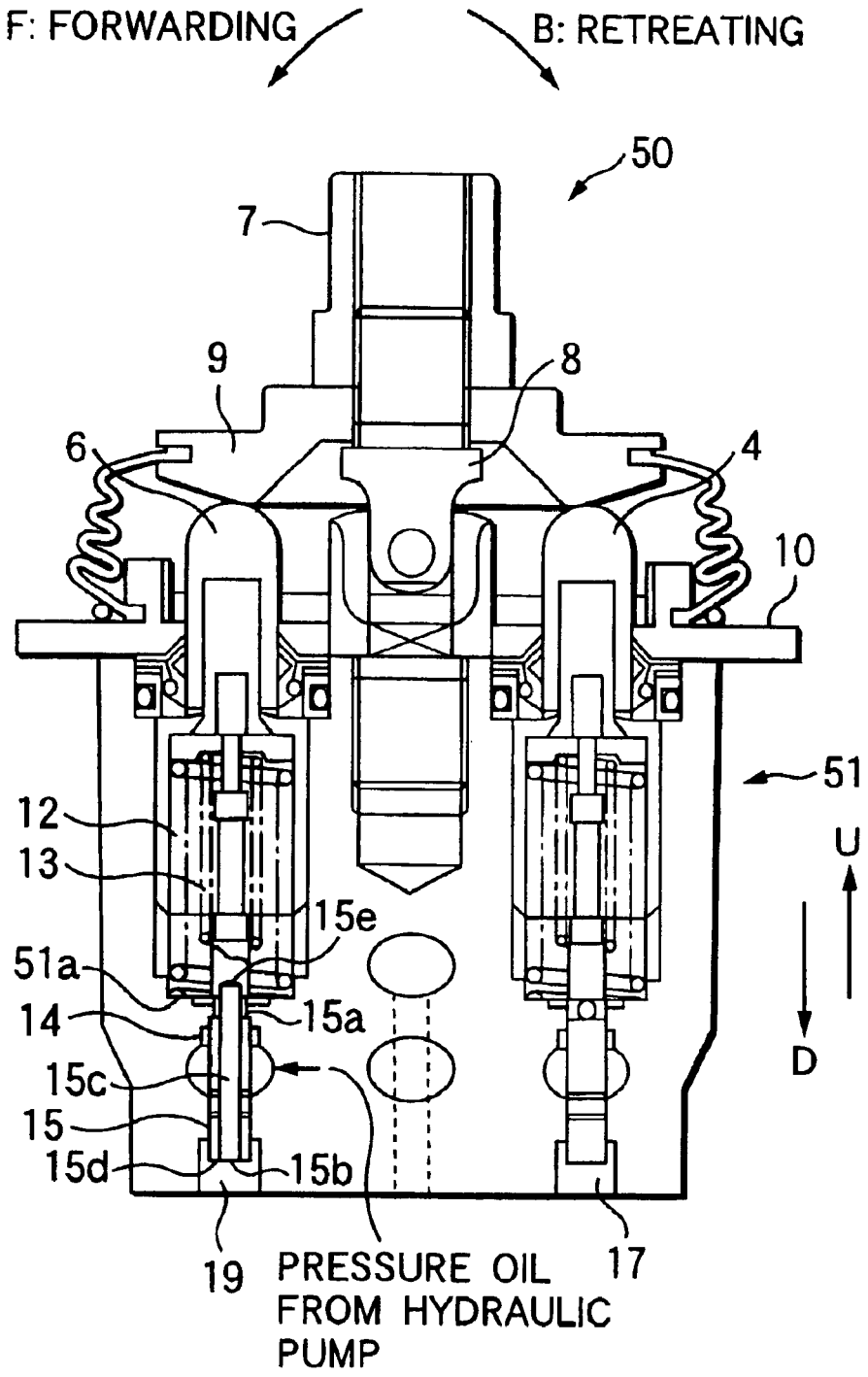
FIG. 12 is a sectional view showing a PPC valve.

In the following, the PPC valve 50 will be explained. The PPC valve 50 is the same as the hydraulic signal output device 50 shown in FIG. 12.

The PPC valve 50 largely includes a body 51 and an operation lever 7 disposed in a tilting-free manner with respect to the body 51.

The operation lever 7 is attached through a free joint 8 and a disc plate 9 to the body 51 so as to be tilted freely in a left and right direction (F, B direction) in FIG. 1 and in a direction perpendicular to a paper surface (L, R direction).

The disc plate 9 is attached to the operation lever 7 so that tip ends (upper end) of pistons 3, 4, 5 and 6 may come into contact with a bottom surface of the disc plate 9.

As shown in FIGS. 11A and 11B, the four pistons 3, 4, 5 and 6 are disposed so that the tip ends of pistons (upper end) may project from an attachment plate 10. The pistons 3, 4, 5 and 6 are disposed so that these may be located at four corners of a square when seen from a top surface of the attachment plate 10. When the operation lever 7 is tilted toward an F direction, the piston 6 is pushed down by the disc plate 9 and pilot pressure oil corresponding to a stroke of the piston 6 is output. Furthermore, when the operation lever 7 is tilted toward a B direction, the piston 4 is pushed down by the disc plate 9 and pilot pressure oil corresponding to a stroke of the piston 4 is output. Still furthermore, when the operation lever 7 is tilted toward an R direction, the piston 3 is pushed down by the disc plate 9 and pilot pressure oil corresponding to a stroke of the piston 3 is output. Furthermore, when the operation lever 7 is tilted toward an L direction, the piston 5 is pushed down by the disc plate 9 and pilot pressure oil corresponding to a stroke of the piston 5 is output.

The pistons 3, 4, 5 and 6 move in accordance with a tilting direction and an amount of tilting of the operation lever 7. In the following, the piston 6 will be explained as a typical example. However, the situations are the same also with respect to the pistons 3, 4 and 5.

As shown in FIG. 1, a first spring 12 is disposed between the piston 6 and a spring washer 51a of the body 51. When the operation lever 7 is tilted toward the F direction, the piston 6, while being subjected to a spring force of the first spring 12, is pushed down toward an arrow mark D direction. The operator can feel sense of operation through the spring force of the first spring 12 when the operation lever 7 is tilted.

In the body 51, for each of the pistons, a pressure-reducing valve 14 for generating pilot pressure oil having a pressure corresponding to a thrust force of the piston is disposed.

Figure 3:
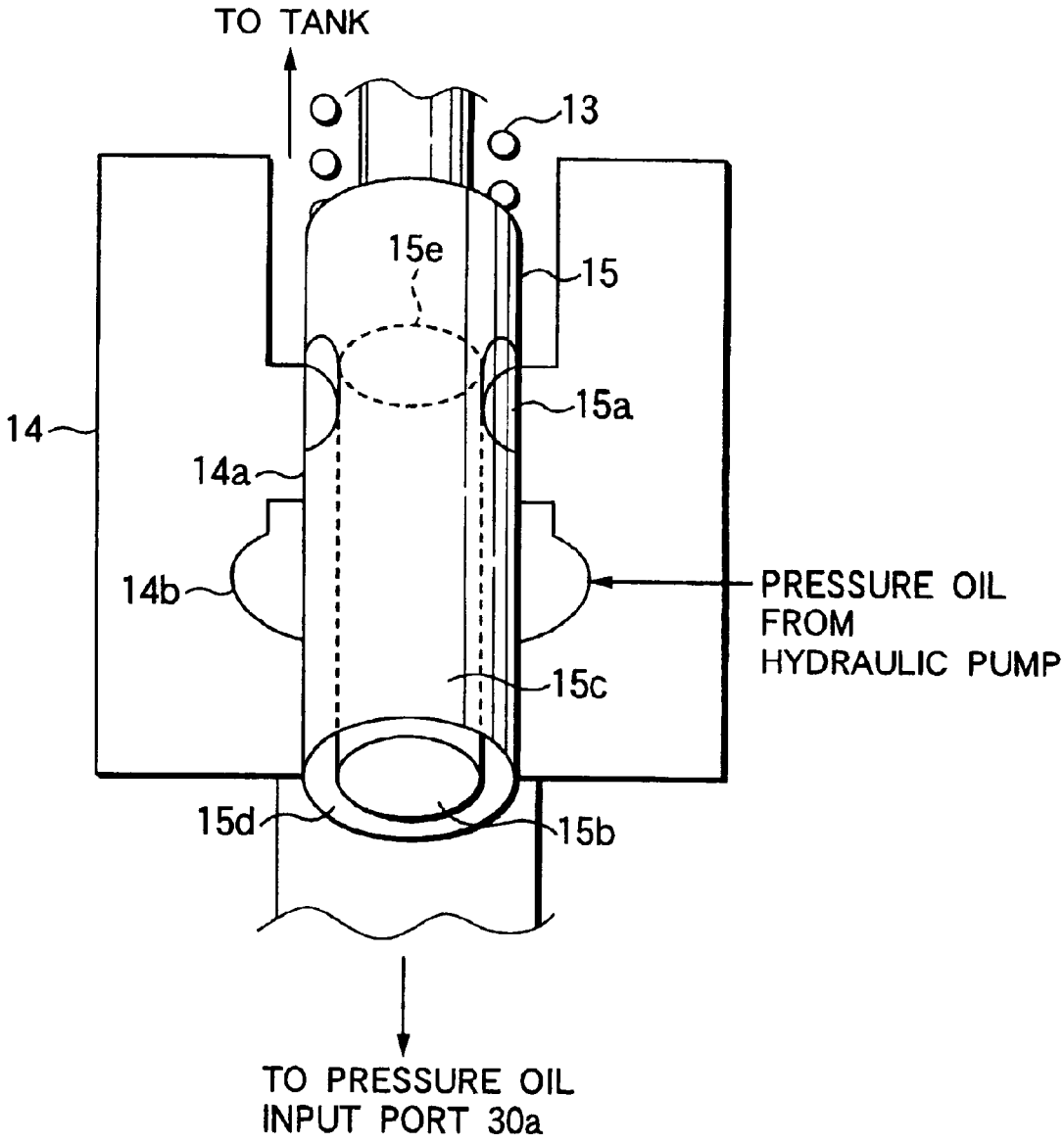
FIG. 3 is a diagram showing a pressure-reducing valve in a simplified way.

FIG. 3 is a drawing showing a pressure-reducing valve of the PPC valve in a simplified manner.

In the pressure-reducing valve 14, a spool slide hole 14*a* is formed. The spool 15 slides in the spool slide hole 14*a* in an arrow mark U direction or an arrow mark D direction.

In the spool slide hole 14*a*, a pressure oil input port 14*b* for inputting pressure oil discharged from a not shown hydraulic pump is formed.

One end of the spool 15 is connected to the piston 6 through a second spring 13. As a result, owing to the thrust force of the piston 6, the spool 15 slides inside of the spool slide hole 14*a*. In a slide surface of the spool 15, a notch 15*a* is formed, and at the other end of the spool 15 a pressure oil output port 15*b* is formed. Inside of the spool 15, an internal pipe line 15*c* that communicates the notch 15*a* and the pressure oil output port 15*b* is formed. The pressure oil output port 15*b* is communicated through a pressure oil input port 30*a* of the shuttle valve 30 with a pilot pipe line 19. In the spool 15, pressure-receiving parts 15*d* and 15*e* are formed and receive pressure of the outputted pilot pressure oil.

The spool 15 receives the pressure of the pilot pressure oil at the pressure-receiving parts 15*d* and 15*e*. The spool 15, upon receiving the pressure due to the pilot pressure oil, moves in an arrow mark U direction, that is, toward the piston 6. Thereby, an area of an opening where the notch 15*a* and the pressure oil input port 14*b* overlap is restricted. As a result, the pressure oil inputted from the hydraulic pump into the pressure-reducing valve 14 is depressurized and outputted into the pilot pipe line 19. The spool 15 stops moving at a position where the pressure of the pilot pressure oil outputted into the pilot pipe line 19 and the spring force of the second spring 13 balance.

In the case of a displacement of the spool 15 in an arrow mark D direction being a predetermined amount or less, that is, an amount of tilting of the operation lever 7 being a predetermined amount or less, the notch 15*a* is not communicated with the pressure oil input port 14*b* but communicated with a not shown tank. In the case of a displacement of the spool 15 in an arrow mark D direction exceeding a predetermined amount, that is, an amount of tilting of the operation lever 7 exceeding a predetermined amount, the notch 15*a* is communicated with the pressure oil input port 14*b*.

Figure 13:
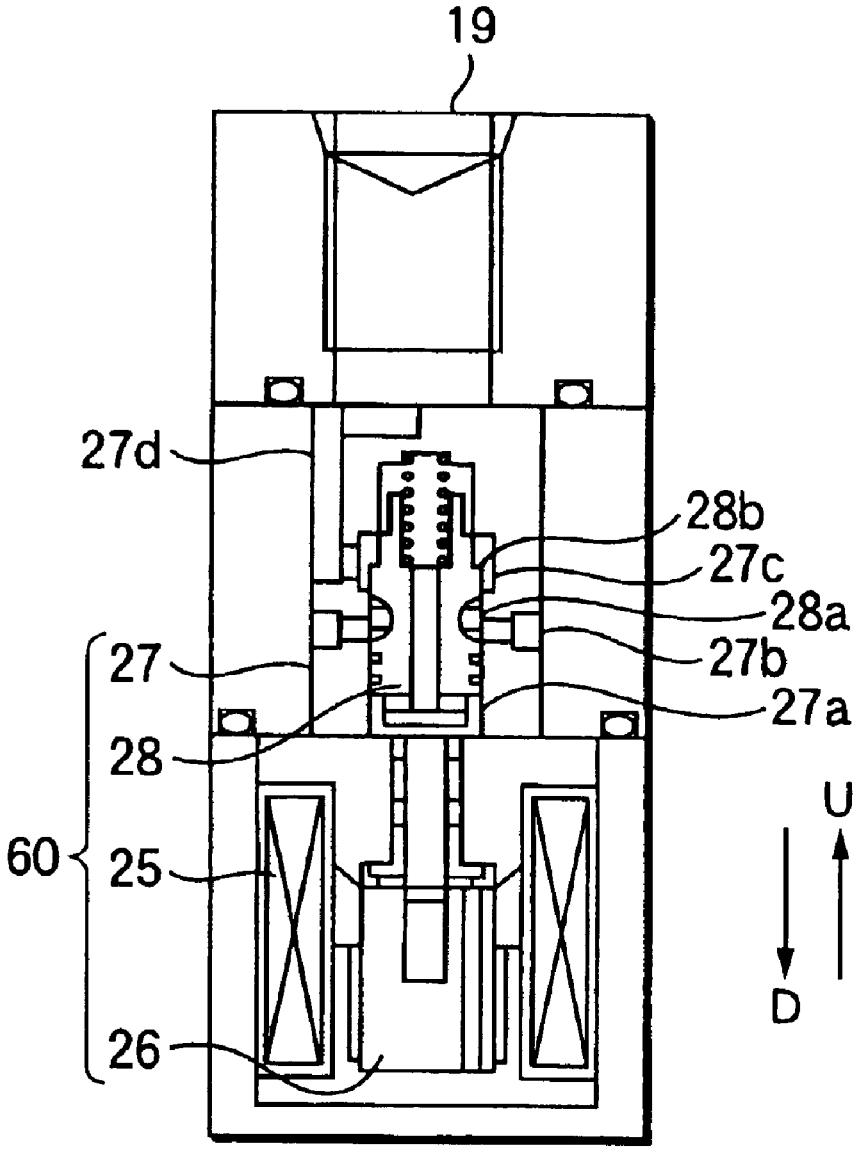
FIG. 13 is a sectional view showing an EPC valve.
Figure 14:
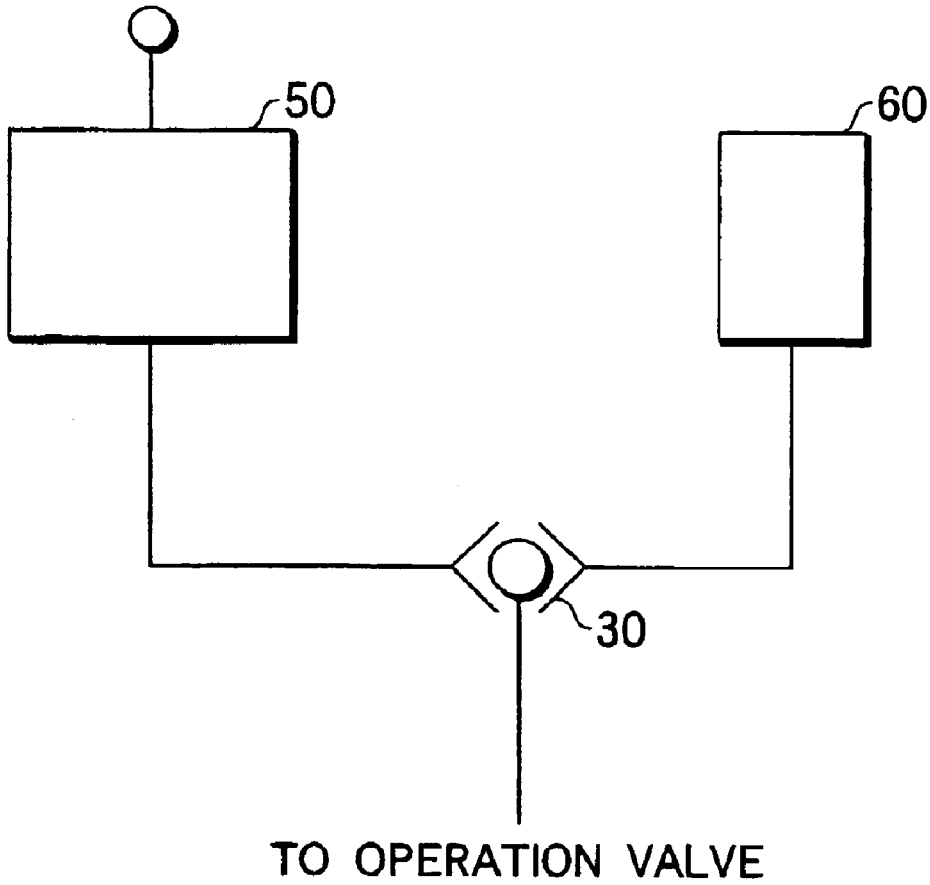
FIG. 14 is an oil pressure circuit showing the PPC valve, the EPC valve and a shuttle valve.

Subsequently, the EPC valve 60 will be explained. The EPC valve 60 is the same as the hydraulic signal output device 60 shown in FIG. 13.

The EPC valve 60 includes a solenoid coil 25, a plunger 26 that moves upon receiving a thrust force that is generated when the solenoid coil 25 is energized, and a pressure-reducing valve 27 that generates pilot pressure oil having a pressure corresponding to a thrust force of the plunger 26.

The plunger 26 is disposed in a center shaft portion of the cylindrical-solenoid coil 25. One end of the plunger 26 is connected with one end of the spool 28 of the pressure-reducing valve 27.

Figure 4:
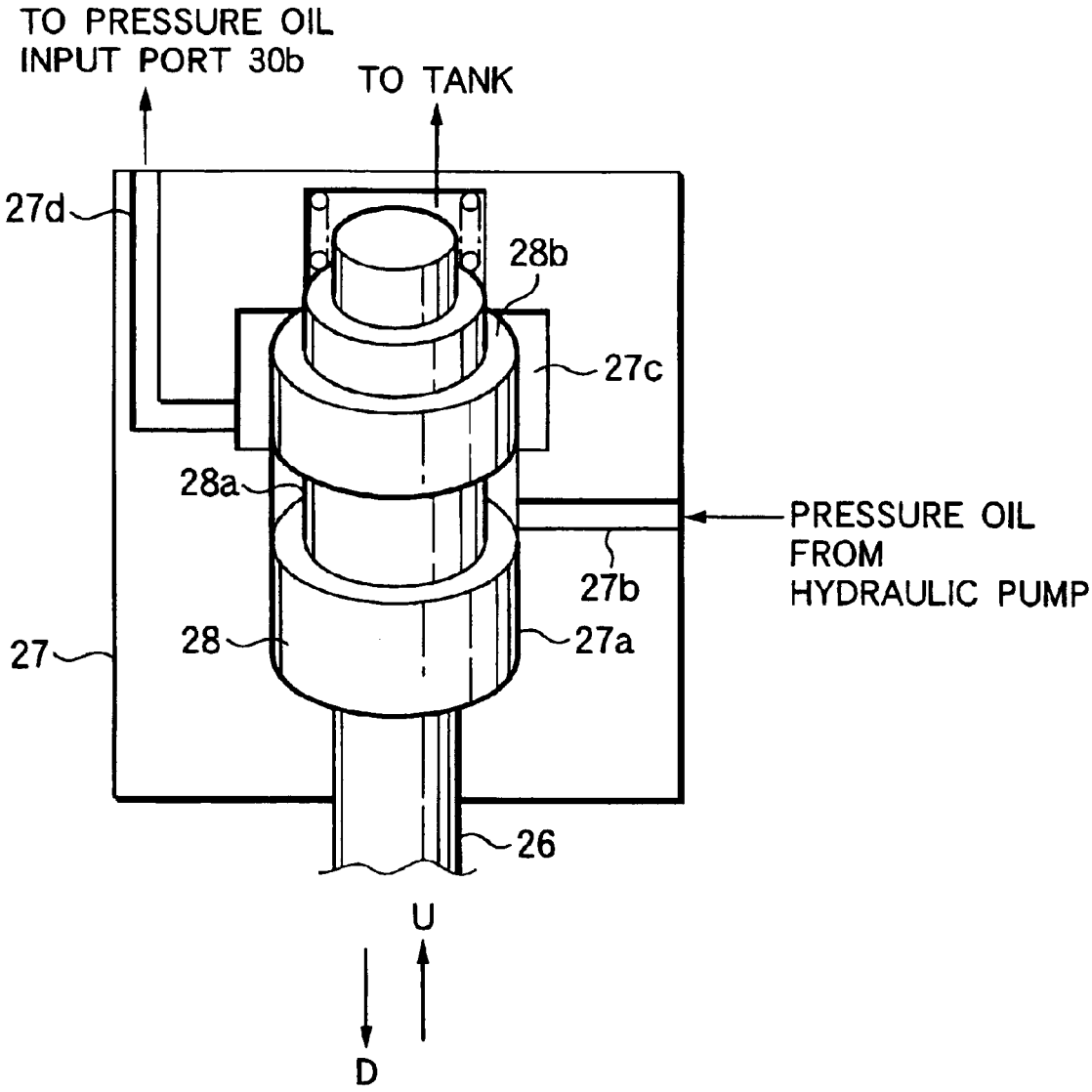
FIG. 4 is a diagram showing a pressure-reducing valve in a simplified way.

FIG. 4 is a drawing showing the pressure-reducing valve of the EPC valve in a simplified manner.

In the pressure-reducing valve 27, a spool slide hole 27*a* is formed. The spool 28 slides in the spool slide hole 27*a* in an arrow mark U direction or an arrow mark D direction.

In the spool slide hole 27*a*, a pressure oil input port 27*b* for inputting pressure oil discharged from a not shown hydraulic pump and a gap 27*c* that is allowed communicating with a pressure oil input port 27*b* owing to the displacement of the spool 28 are formed. The gap 27*c* is communicated through the pressure oil output port 27*d* and a pressure oil input port 30*b* of the shuttle valve 30 with the pilot pipe line 19.

One end of the spool 28 is connected to the plunger 26. As a result, as the plunger 26 displaces, the spool 28 slides inside of the spool slide hole 27*a*. In a slide surface of the spool 28, a notch 28*a* is formed. Furthermore, in a slide surface of the spool 28, an annular part 28*b* that, when the pressure oil input port 27*b* and the gap 27*c* are communicated, is located inside of the gap 27*c* and receives the pressure of the outputted pilot pressure oil is formed. The pressure of the pilot pressure oil acts on the annular part 28*b* of the spool 28. The spool 28, upon receiving the pressure due to the pilot pressure oil, moves in an arrow mark D direction, that is, toward the plunger 26. The plunger 26 moves, upon receiving the thrust force due to the spool 28, toward an arrow mark D direction. Thereby, an area of an opening where the notch 28*a* and the gap 27*c* overlap is restricted. As a result, the pressure oil inputted from the hydraulic pump into the pressure-reducing valve 27 is depressurized and outputted into the pilot pipe line 19. The spool 28 stops moving at a position where the pressure of the pilot pressure oil and the thrust force of the plunger 26 balance.

In the case of a displacement of the spool 28 in an arrow mark U direction being a predetermined amount or less, that is, an electric current flowing in the solenoid coil 25 being a predetermined amount or less, the pressure oil input port 27*b* is not communicated with the gap 27*c* but communicated with a not shown tank. In the case of a displacement of the spool 28 in an arrow mark U direction exceeding a predetermined amount, that is, an electric current flowing in the solenoid coil 25 exceeding a predetermined amount, the pressure oil input port 27*b* is communicated through the notch 28*a* with the gap 27*c*.

Next, the shuttle valve 30 will be explained.

In the shuttle valve 30, pressure oil input ports 30*a* and 30*b* and a pressure oil output port 30*c* are formed. A ball 31 is disposed with the pressure oil input port 30*a* and the pressure oil input port 30*b* freely closable. The pressure oil input port 30*a* is communicated with the pressure oil output port 15*b* of the pressure-reducing valve 14. The pressure oil input port 30*b* is communicated with the pressure oil output port 27*d* of the pressure-reducing valve 27. The pressure oil output port 30*c* is communicated with the pilot pipe line 19. When the ball 31 closes a pressure oil input portion 30*b* side, the pressure oil input portion 30*a* is communicated with the pressure oil output portion 30*c*. When the ball 31 closes a pressure oil input port 30*a* side, the pressure oil input port 30*b* is communicated with the pressure oil output port 30*c*.

The hydraulic signal output device 1, other than being operated with the operation lever 7, can be operated also with an operation part 35 shown in FIG. 2. The operation part 35 shown in FIG. 2 is a wireless device disposed outside the vehicle, and according to the operation at the operation part 35 an energizing instruction is radio-transmitted. With the energizing instruction, a magnitude of an electric current that is allowed flowing in the solenoid coil 25 can be instructed. A receiving part 36 receives the energizing instruction transmitted from the operation part 35. A control part 37, based on the energizing instruction received at the receiving part 36, controls the electric current that flows in the solenoid coil 25.

Subsequently, operations of the hydraulic signal output device 1 will be explained.

First, a case where an operator tilts the operation lever 7 in operating will be explained with reference to FIGS. 1, 2 and 3.

FIGS. 1 and 2 show a state where the operation lever 7 is in a neutral position. In this state, it is assumed that the operation lever 7 is tilted toward the piston 6 (F direction in FIG. 1). At this, the piston 6 at the left side in FIG. 1 receives the thrust force through the disc plate 9 and moves in an arrow mark D direction, that is, toward the spool 15. The spool 15 receives the thrust force due to the piston 6 through the second spring 13 and moves in an arrow mark D direction, that is, toward the shuttle valve 30 side.

The spool 15 receives the pressure of the pilot pressure oil at the pressure-receiving portions 15*d* and 15*e*. The spool 15, upon receiving the pressure due to the pilot pressure oil, moves in an arrow mark U direction, that is, toward the piston 6 side. Thereby, an area of an opening where the notch 15*a* and the pressure oil input port 14*b* overlap is restricted. As a result, the pressure oil that is inputted from the hydraulic pump into the pressure-reducing valve 14 is depressurized and outputted into the pilot pipe line 19. When the pressure of the pilot pressure oil outputted into the pilot pipe line 19 and the spring force of the second spring 13 establish a balance, the spool 15 stops moving.

When a displacement in an arrow mark D direction of the spool 15 exceeds a predetermined amount, the notch portion 15*a* is communicated with the pressure oil input port 14*b*. Accordingly, the pressure oil that is discharged from a not shown hydraulic pump is outputted through the pressure oil input port 14*b*, the notch portion 15*a* and an internal pipe line 15*c* from the pressure oil output port 15*b* into the pressure oil input port 30*a* of the shuttle valve 30. The pressure of the outputted pressure oil establishes a balance with the spring force of the second spring 13.

The pressure oil inputted into the shuttle valve 30 moves the ball 31 in an arrow D direction, that is, toward the pressure oil input port 30*b* and closes the pressure oil input port 30*b* and opens the pressure oil input port 30*a*. Thereby, the pressure oil output port 15*b* of the pressure-reducing valve 14 is communicated with the pilot pipe line 19. The pressure oil output port 27*d* of the pressure-reducing valve 27 is cut off the pilot pipe line 19.

Thus, the pilot pressure oil Pp having a magnitude in accordance with a tilting amount of the operation lever 7 is outputted into the pilot pipe line 19. Similarly, when in accordance with the tilting of the operation lever 7, each of the pistons 3, 4 and 5 moves, the pilot pressure oil Pp is outputted into each of the pilot pipe lines 16, 17 and 18.

Subsequently, a case where a person other than an operator who operates the hydraulic signal output device 1 in the vehicle operates the operation part 35 will be explained with reference to FIGS. 1, 2 and 3.

FIGS. 1 and 2 show a state where an electric current does not flow in the solenoid coil 25. In this state, it is assumed that the operation part 35 is operated and the energizing instruction is radio-transmitted. The energizing instruction is received at the receiving part 36 and sent to the control part 37. The control part 37 allows a current having a magnitude shown in the content of the energizing instruction to flow. Thereby, the thrust force corresponding to the magnitude of the current is generated, and thereby the plunger 26 is moved in an arrow mark U direction, that is, toward the spool 28 side. The spool 28, upon receiving the thrust force due to the plunger 26, moves in an arrow mark U direction, that is, toward the shuttle valve 30 side.

The pressure of the pilot pressure oil acts on the annular part 28*b* of the spool 28. The spool 28, upon receiving the pressure due to the pilot pressure oil, moves in an arrow mark D direction, that is, toward the plunger 26. The plunger 26, upon receiving the thrust force due to the spool 28, moves toward an arrow mark D direction. Thereby, an area of an opening where the notch 28*a* and the gap 27*c* overlap is restricted. As a result, the pressure oil inputted from the hydraulic pump into the pressure-reducing valve 27 is depressurized and outputted into the pilot pipe line 19. The spool 28 stops moving at a position where the pressure of the pilot pressure oil establishes a balance with the thrust force of the plunger 26.

When the displacement of the spool 28 in an arrow mark U direction exceeds a predetermined amount, the pressure oil input port 27*b* and the gap 27*c* are communicated through the notch 28*a*. Accordingly, the pressure oil that is discharged from a not shown hydraulic pump is outputted through the pressure oil input port 27*b*, the notch 28*a* and the gap 27*c* from the pressure oil output port 27*d* into the pressure oil input port 30*b* of the shuttle valve 30. The pressure of the outputted pressure oil establishes a balance with the thrust force of the plunger 26.

The pressure oil inputted into the shuttle valve 30 moves the ball 31 in an arrow U direction, that is, toward the pressure oil input port 30*a* side and closes the pressure oil input port 30*a* and opens the pressure oil input port 30*b*. Thereby, the pressure oil output port 27*d* of the pressure-reducing valve 27 is communicated with the pilot pipe line 19. The pressure oil output port 15*b* of the pressure-reducing valve 14 is cut off the pilot pipe line 19.

Thus, the pilot pressure oil Pp having a magnitude in accordance with the energizing instruction radio-transmitted from the operation part 35 is outputted into the pilot pipe line 19.

In the first embodiment, various hydraulic machines such as the PPC valve 50, the EPC valve 60 and the shuttle valve 30 are integrally formed. Accordingly, since the installation space of the hydraulic machines can be made smaller, a space for other than the hydraulic machines can be made larger.

In the following, a second embodiment will be explained.

Figure 5:
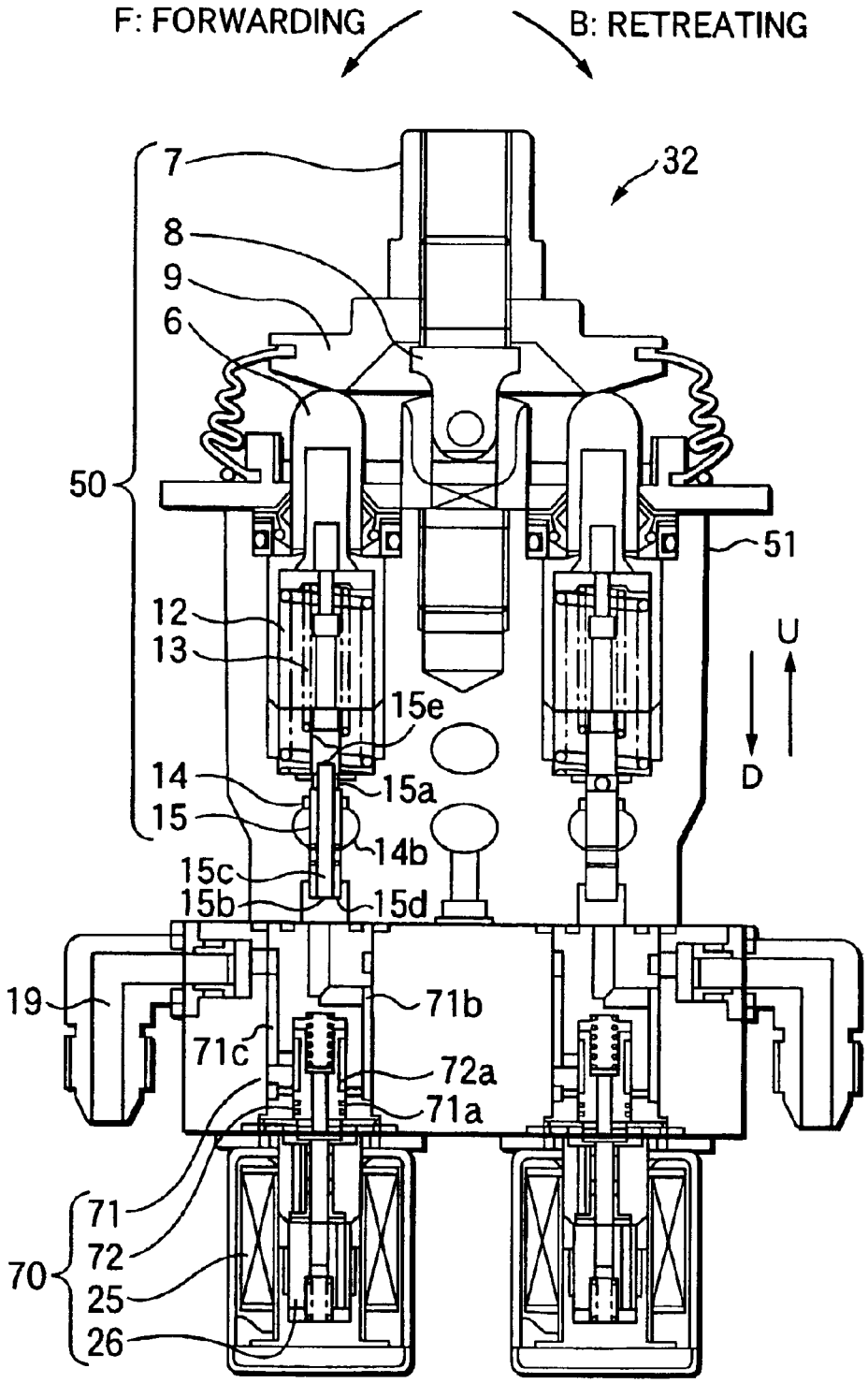
FIG. 5 is a sectional view showing a second embodiment of the present invention.
Figure 6:
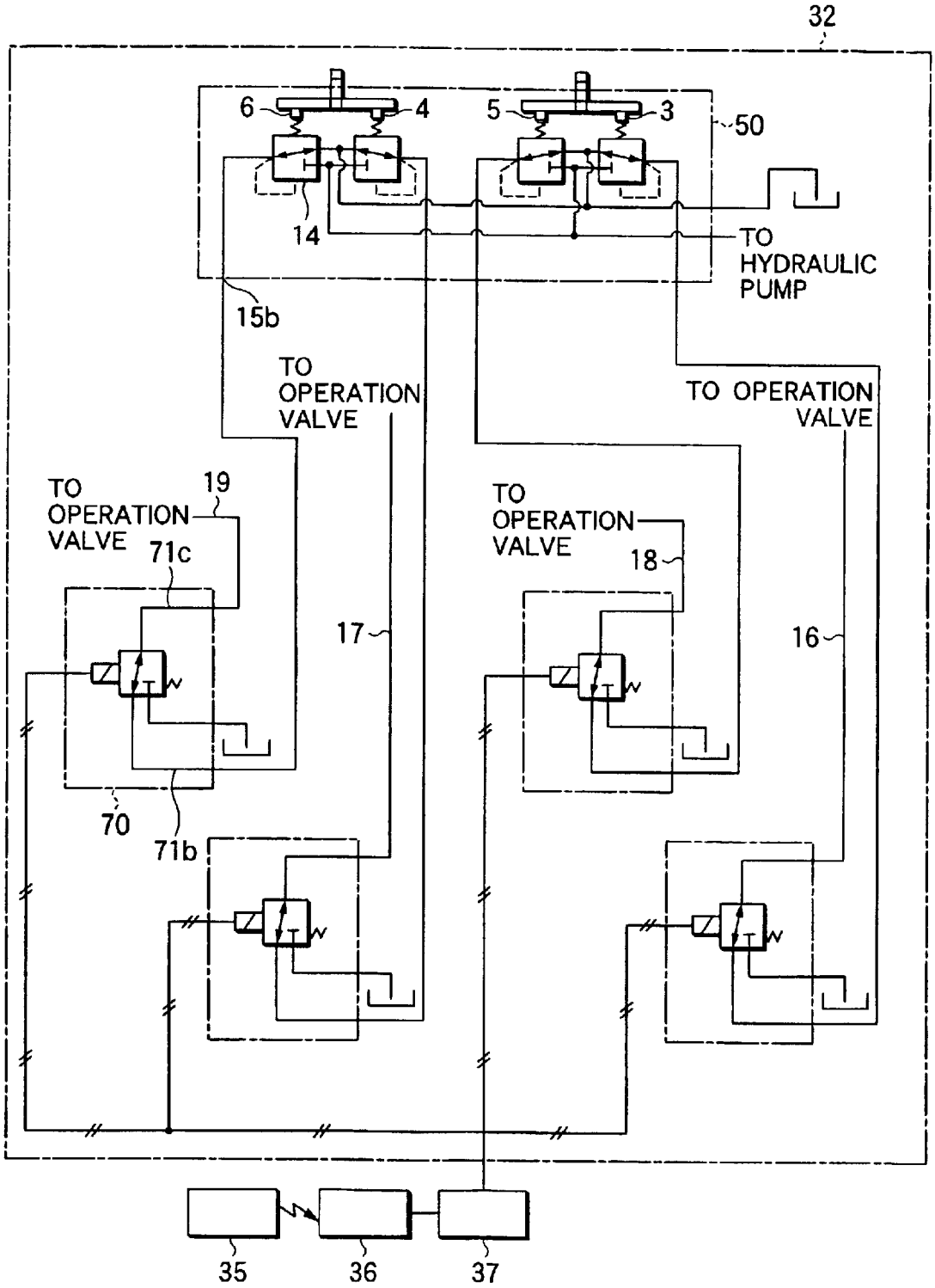
FIG. 6 is a diagram showing an oil pressure circuit of the second embodiment.

FIG. 5 is a sectional view showing a second embodiment of the present invention. FIG. 6 is a drawing showing an oil pressure circuit of the second embodiment. FIGS. 11A and 11B show movement of an operation lever shown in FIG. 5. FIG. 5 is a drawing of an A—A section of FIG. 11A seen from left. These drawings will be together referenced to explain the second embodiment.

A hydraulic signal output device 32 shown in FIG. 5 largely includes a PPC valve 50 and an electromagnetic valve 70.

In the second embodiment, the electromagnetic valve 70 cuts off pilot pressure oil outputted from the PPC valve 50. When an operation part 35 is operated, the electromagnetic valve 70 is actuated.

The PPC valve 50 is the same as that explained in the first embodiment. Accordingly, an explanation thereof will be omitted.

The electromagnetic valves 70 are disposed corresponding to each of pistons 3, 4, 5 and 6 of the PPC valve 50. Each of the electromagnetic valves 70 is provided with a solenoid coil 25, a plunger 26 that moves when the thrust force that is generated in accordance with a current flowing in the solenoid coil 25 is received, and a switching valve 71 that allows a pressure oil output port 15*b* of a pressure-reducing valve 14 communicating with or cutting off a pilot pipe line 19 owing to the thrust force of the plunger 26.

The plunger 26 is disposed in a center shaft portion of the cylindrical solenoid coil 25. One end of the plunger 26 is connected to one end of a spool 72 of the switching valve 71.

In the switching valve 71, a spool slide hole 71*a* is formed. The spool 72 slides in the spool slide hole 71*a* in an arrow U direction or an arrow D direction.

In the spool slide hole 71*a*, a pressure oil input port 71*b* that inputs the pressure oil discharged from the PPC valve 50, and a pressure oil output port 71*c* that is communicated with the pressure oil input port 71*b* owing to the displacement of the spool 72 are formed. The pressure oil input port 71*b* is communicated with the pressure oil output port 15*b* of the pressure-reducing valve 14, and the pressure oil output port 71*c* is communicated with the pilot pipe line 19.

One end of the spool 72 is connected with the plunger 26. Accordingly, as the plunger 26 moves, the spool 72 slides inside of the spool slide hole 71*a*. In a sliding surface of the spool 72, a notch 72*a* is formed. The notch 72*a* allows the pressure oil input port 71*b* to communicate with the pressure oil output port 71*c*.

In the case of a displacement in an arrow mark U direction of the spool 72 being a predetermined amount or less, that is, a current flowing in the solenoid coil 25 being a predetermined amount or less, the pressure oil input port 71*b* is communicated through the notch 72*a* with the pressure oil output port 71*c*. In the case of a displacement in an arrow mark U direction of the spool 72 exceeding a predetermined amount, that is, a current flowing in the solenoid coil 25 exceeding a predetermined amount, the pressure oil input port 71*b* is cut off the pressure oil output port 71*c*.

Subsequently, the operations of the hydraulic signal output device 32 will be explained.

FIGS. 5 and 6 show a state where the operation lever 7 is in a neutral position. Furthermore, the drawings show a state where a current does not flow in the solenoid coil 25. In this state, it is assumed that the operation lever 7 is tilted toward the piston 6 (F direction in FIG. 5). Thereby, the pressure oil outputted from the pressure oil output port 15*b* of the pressure-reducing valve 14 is outputted through the pressure oil input port 71*b*, the notch 72*a* and the pressure oil output port 71*c* to the pilot pipe line 19.

In this state, it is assumed that the operation part 35 is operated and the energizing instruction is radio-transmitted. In the energizing instruction, a current sufficient to displace the plunger 26 flows in the solenoid coil 25. The energizing instruction is received at the receiving part 36 and sent to the control part 37. The control part 37 allows a current having a magnitude shown in the content of the energizing instruction to flow in the solenoid coil 25. Thereby, the thrust force corresponding to the magnitude of the current is generated, and thereby the plunger 26 is moved in an arrow mark U direction, that is, toward the spool 72. The spool 72, upon receiving the thrust force due to the plunger 26, moves in an arrow mark U direction, that is, toward the PPC valve 50 side.

When a displacement of the spool 72 in an arrow mark U direction exceeds a predetermined amount, the pressure oil input port 71*b* is cut off the pressure oil output port 71*c* by means of the spool 71*c*. That is, the pressure oil output port 15*b* of the pressure-reducing valve 14 is cut off the pilot pipe line 19 by means of the electromagnetic valve 70.

Thus, in the hydraulic signal output device 32, when the current is not flowing in the solenoid coil 25, the pilot pressure oil is outputted from the PPC valve 50 to the pilot pipe line 19. However, when the current is flowing in the solenoid coil 25, the pilot pressure oil outputted from the PPC valve 50 is cut off the pilot pipe line 19 by means of the electromagnetic valve 70 and is not outputted thereto. When the operation part 35 is operated and allows the current to flow in the solenoid coil 25, the pressure oil supplied to a not shown hydraulic motor is stopped, resulting in stopping the vehicle.

In the second embodiment, by allowing the current to flow in the solenoid coil 25, the pressure oil input port 71*b* of the switching valve 71 is cut off the pressure oil output port 71*c* thereof. However, by not allowing the current to flow in the solenoid coil 25, the pressure oil input port 71*b* of the switching valve 71 may not cut off the pressure oil output port 71*c* thereof.

Next, a third embodiment will be explained.

Figure 7:
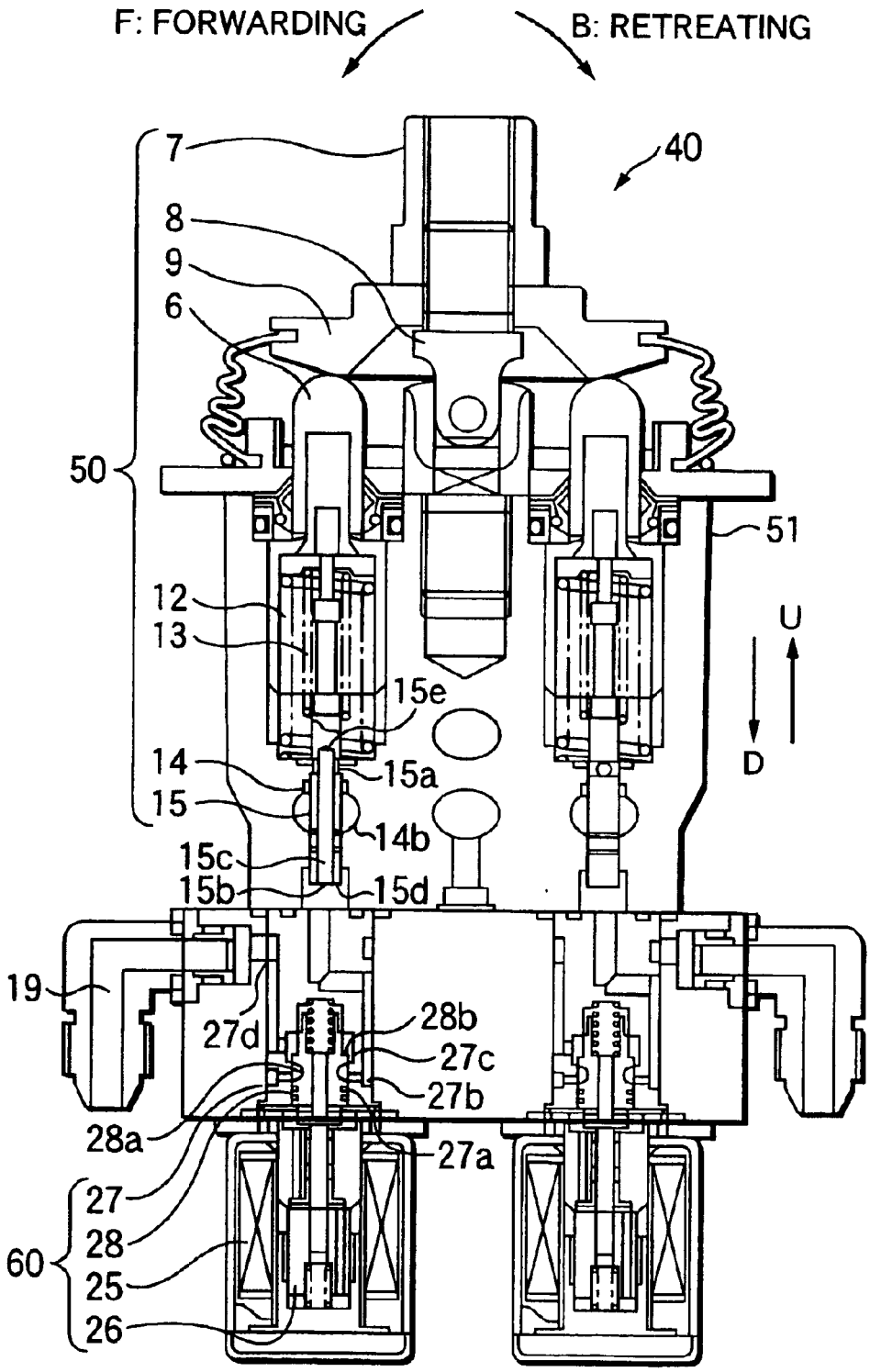
FIG. 7 is a sectional view showing a third embodiment of the present invention.
Figure 8:
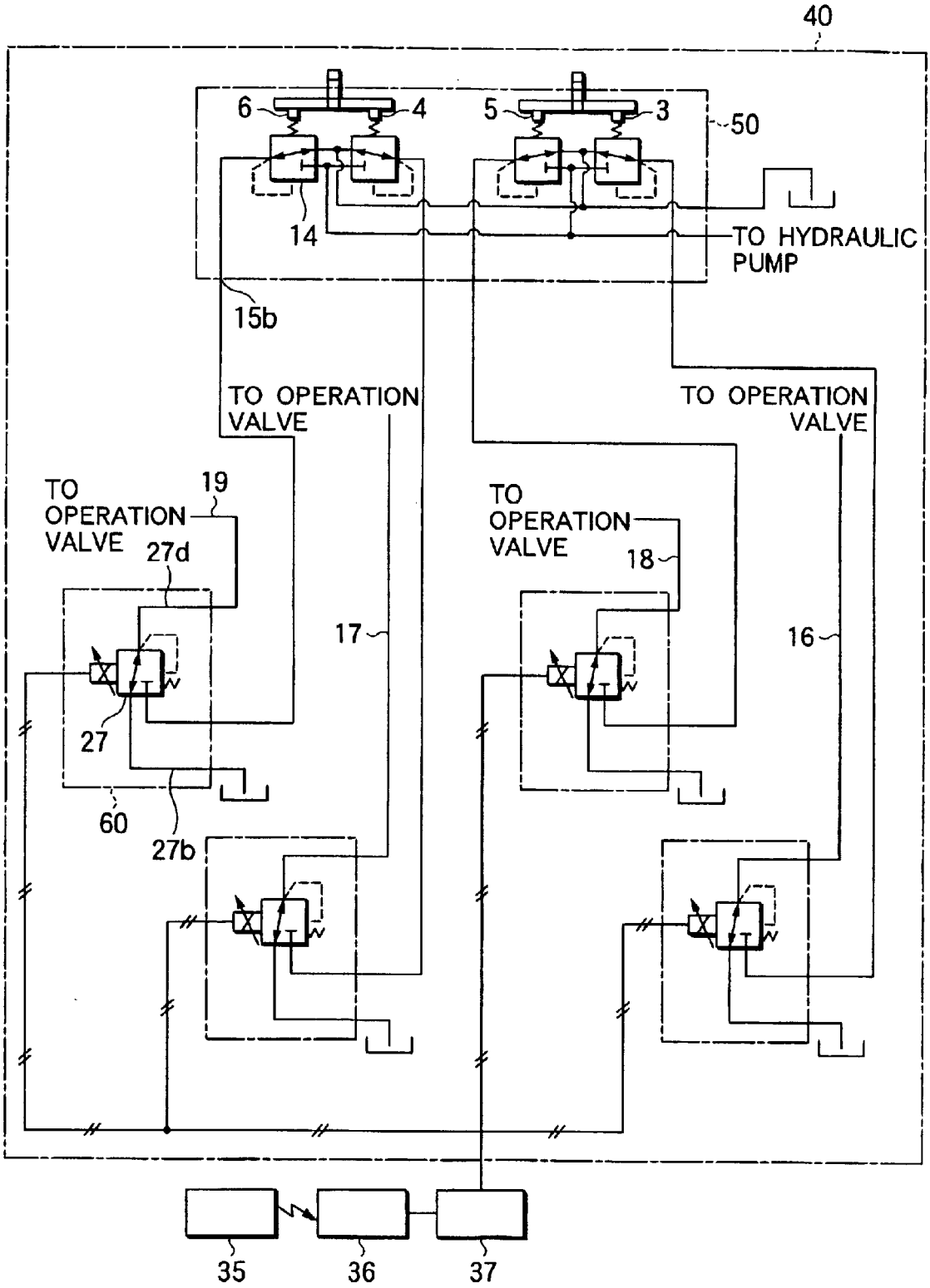
FIG. 8 is a diagram showing an oil pressure circuit of the third embodiment.

FIG. 7 is a sectional view showing a third embodiment of the present invention. FIG. 8 is a drawing showing an oil pressure circuit of the third embodiment. Furthermore, FIGS. 11A and 11B show movement of an operation lever shown in FIG. 7. FIG. 7 is a drawing of an A—A section seen from left of FIG. 11A. These drawings will be together referenced to explain the third embodiment.

A hydraulic signal output device 40 shown in FIG. 7, largely includes a PPC valve 50 and an EPC valve 60.

In the third embodiment, the pilot pressure oil outputted from the PPC valve 50 is depressurized by use of the EPC valve 60. When the operation part 35 is operated, the EPC valve 60 is actuated.

The PPC valve 50 and the EPC valve 60 are the same as those explained in the first embodiment. Accordingly, an explanation thereof will be omitted.

The pressure oil output port 15*b* of the pressure-reducing valve 14 in the PPC valve 50 is communicated with the pressure oil input port 27*b* of the pressure-reducing valve 27 in the EPC valve 60. Furthermore, the pressure oil output port 27*d* of the pressure-reducing valve 27 is communicated with the pilot pipe line 19. The PPC valve 50 and the EPC valve 60 are integrally formed.

In the following, operations of the hydraulic signal output device 40 will be explained.

FIGS. 7 and 8 show a state where the operation lever 7 is in a neutral position and a state where a current is not flowing in the solenoid coil 25.

When a not shown engine is started operating, a predetermined amount of an electric current flows in the solenoid coil 25, and the spool 28 is moved toward the PPC valve 50 side, that is, in an arrow mark U direction. At that time, the pressure oil input port 15*b* is communicated through the pressure oil input port 27*b*, the notch 28*a*, the gap 27*c* and the pressure oil output port 27*d* with the pilot pipe line 19. When there is no external energizing instruction while the engine of the vehicle is operating, a predetermined amount of current keeps on flowing in the solenoid coil 25. In a state where the predetermined amount of the current keeps on flowing in the solenoid coil 25, it is assumed that the operation lever 7 is tilted toward the piston 6 (F direction in FIG. 7). Thereby, the pressure oil that is outputted from the pressure oil output port 15*b* is outputted through the pressure oil input port 27*b*, the notch 28*a*, the gap 27*c* and the pressure oil output port 27*d* to the pilot pipe line 19.

In this state, it is assumed that the operation part 35 is operated and an energizing instruction is radio-transmitted. The energizing instruction is received at the receiving part 36 and is sent to the control part 37. The control part 37 allows a current having a magnitude shown in the content of the energizing instruction to flow. When, in accordance with the energizing instruction, the current flowing in the solenoid coil 25 is made smaller than the predetermined amount, the generated thrust force becomes smaller. The spool 28 is subjected to the pressure of the pilot pressure oil acting on the annular part 28*b* and is moved in an arrow D direction, that is, toward the plunger 26 side. Thereby, an area of the opening through which the notch 28*a* and the gap 27*c* overlap is restricted. As a result, the pressure oil that is inputted from the PPC valve 50 to the pressure-reducing valve 27 is depressurized and outputted to the pilot pipe line 19. The spool 28 ceases moving at a position where the pressure of the pilot pressure oil and the thrust force of the plunger 26 establish a balance.

By performing as mentioned above, in the hydraulic signal output device 40, as the current flowing in the solenoid coil 25 becomes smaller, the pilot pressure oil having a smaller pressure can be outputted into the pilot pipe line 19. Accordingly, when the operation part 35 is operated and the current flowing in the solenoid coil 25 is made gradually smaller, the pilot pressure oil supplied to a not shown operation valve can be gradually depressurized. Thereby, since the pressure oil supplied to the hydraulic motor decreases gradually, a speed of a running vehicle can be gradually lowered, resulting in standing still.

In the following, a fourth embodiment will be explained.

Figure 9:
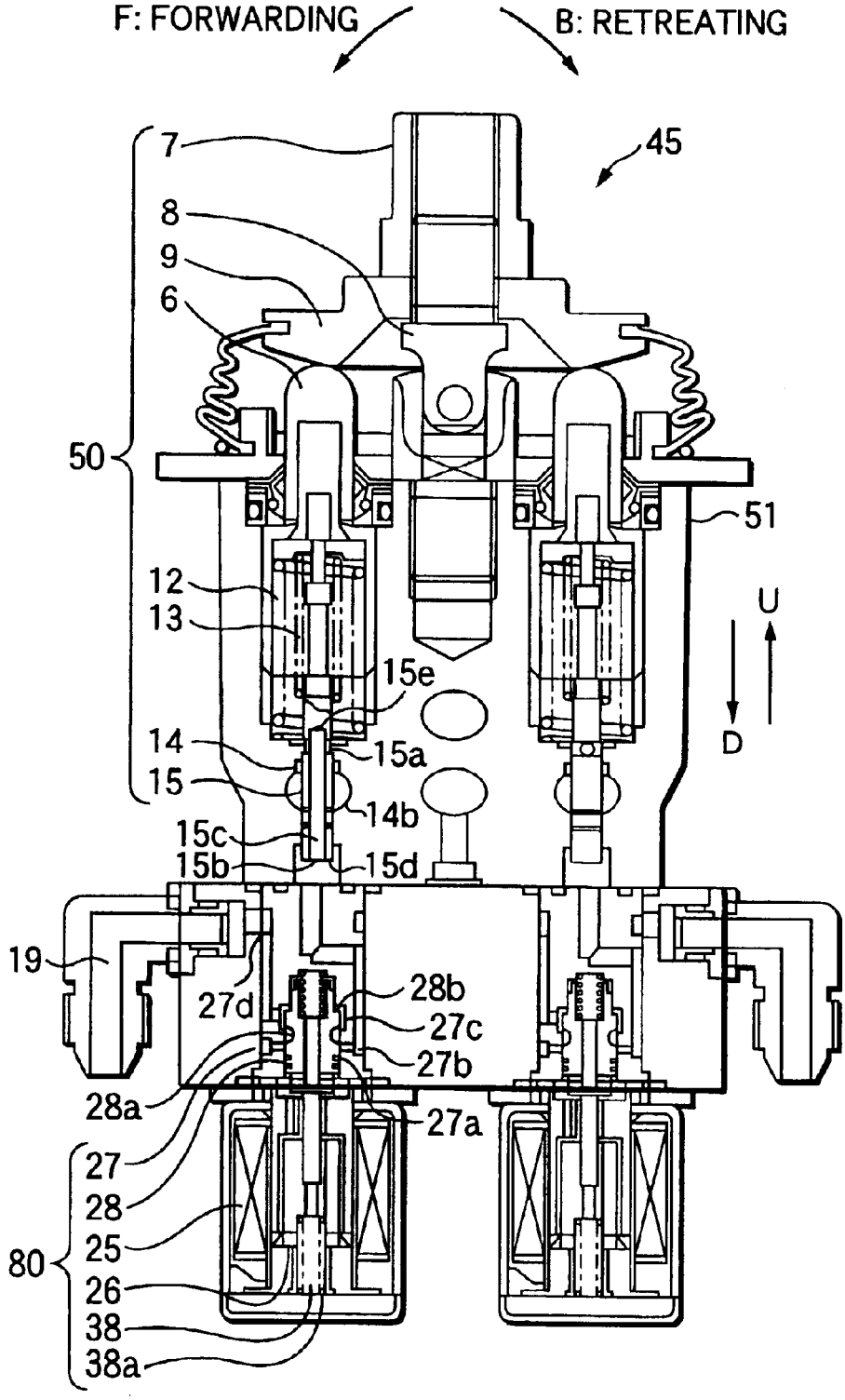
FIG. 9 is a sectional view showing a fourth embodiment of the present invention.
Figure 10:
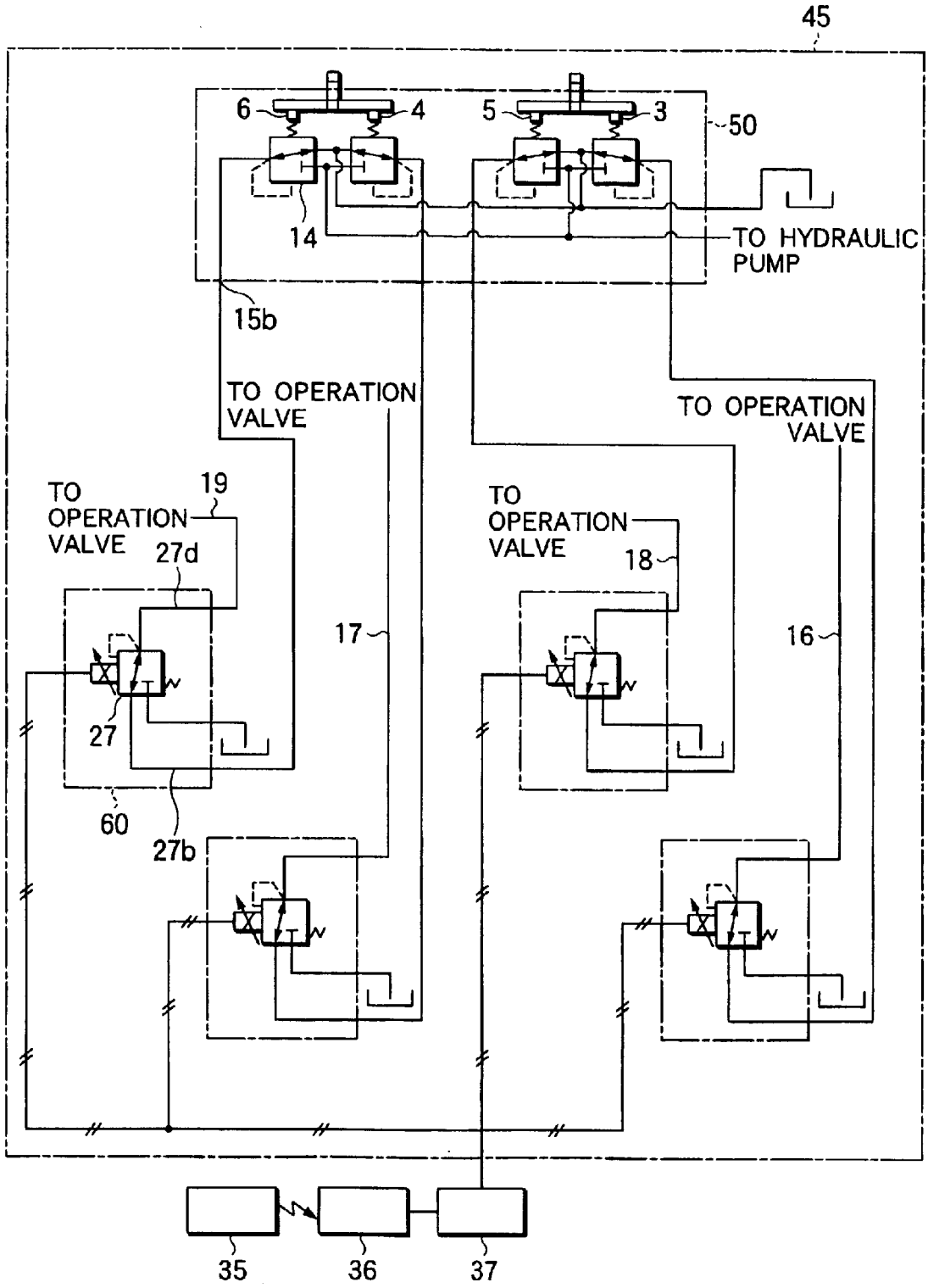
FIG. 10 is a diagram showing an oil pressure circuit of the fourth embodiment.

FIG. 9 is a sectional view showing a fourth embodiment of the present invention. FIG. 10 is a drawing showing an oil pressure circuit of the fourth embodiment. FIGS. 11A and 11B show movement of an operation lever shown in FIG. 9. FIG. 9 is a drawing of an A—A section of FIG. 11A seen from left. These drawings will be together referenced to explain the fourth embodiment.

A hydraulic signal output device 45 shown in FIG. 9 largely includes a PPC valve 50 and an EPC valve 80.

In the fourth embodiment, pilot pressure oil outputted from the PPC valve 50 is depressurized with the EPC valve 80. The EPC valve 80 is operated when the operation part 35 is operated. While in the third embodiment, when the current flowing in the solenoid coil 25 of the EPC valve 60 is made smaller, the pressure of the pilot pressure oil outputted from the pilot pipe line 19 becomes smaller, in the fourth embodiment, when the current flowing in the solenoid coil 25 of the EPC valve 80 is made larger, the pressure of the pressure oil outputted from the pilot pipe line 19 becomes smaller.

The PPC valve 50 is the same as that explained in the first embodiment. Accordingly, an explanation thereof will be omitted. Furthermore, the EPC valve 80 will be explained only of portions different from the EPC valve 60 that is explained in the first embodiment.

A pressure oil output port 15*b* of the pressure-reducing valve 14 in the PPC valve 50 is communicated with a pressure oil input port 27*b* of the pressure-reducing valve 27 in the EPC valve 80. Furthermore, a pressure oil output port 27*d* of the pressure-reducing valve 27 in the EPC valve 80 is communicated with the pilot pipe line 19. The PPC valve 50 and the EPC valve 80 are integrally formed.

One end of the plunger 26 of the EPC valve 80 is connected with the spool 28 of the pressure-reducing valve 27. The other end of the plunger 26 is connected with one end of a spring 38. The other end of the spring 38 is connected with a spring washer 38*a*. When a current flows in the solenoid coil 25, the thrust force is applied on the plunger 26 toward the spring 38 side. The EPC valve 80 is called a proportional EPC valve, and the thrust force proportional to a magnitude of the current flowing in the solenoid coil 25 acts in an arrow mark D direction.

In the case of a displacement of the spool 28 in an arrow mark D direction being a predetermined amount or less, that is, the current flowing in the solenoid coil 25 being a predetermined amount or less, the pressure oil input port 27*b* is communicated through the notch 28*a* with the gap 27*c*. In the case of a displacement of the spool 28 in an arrow mark D direction exceeding a predetermined amount, that is, the current flowing in the solenoid coil 25 exceeding a predetermined amount, the pressure oil input port 27*b* is cut off the gap 27*c*.

Subsequently, operations of the hydraulic signal output device 45 will be explained.

FIGS. 9 and 10 show a state where the operation lever 7 is in a neutral position. Furthermore, the drawings show a state where a current does not flow in the solenoid coil 25. In this state, it is assumed that the operation lever 7 is tilted toward the piston 6 (F direction in FIG. 9). Thereby, the pressure oil outputted from the pressure oil output port 15*b* is outputted through the pressure oil input port 27*b*, the notch 28*a*, the gap 27*c* and the pressure oil output port 27*d* to the pilot pipe line 19.

It is assumed that, in this state, the operation part 35 is operated and an energizing instruction is radio-transmitted. The energizing instruction is received at the receiving part 36 and sent to the control part 37. The control part 37 allows a current having a magnitude shown in the content of the energizing instruction to flow in the solenoid coil 25. When the current flowing in the solenoid coil 25 is made larger in accordance with the energizing instruction, a larger thrust force is generated. Thereby, owing to the generated thrust force, the plunger 26 is moved in an arrow mark D direction, that is, toward the spring 38 side. The spool 28, upon receiving the thrust force due to the plunger 26, moves in an arrow mark D direction, that is, toward the EPC valve 80 side. Thereby, the spring 38 is forced to contract.

The pressure oil inputted from the PPC valve 50 into the pressure-reducing valve 27 is depressurized and outputted to the pilot pipe line 19. The spool 28 stops moving at a position where the pressure of the pilot pressure oil acting on the spool 28 and the thrust force acting on the plunger 26 establish a balance with the spring force of the spring 38.

As mentioned above, in the hydraulic signal output device 45, as the current flowing in the solenoid coil 25 becomes larger, the pilot pressure oil having a smaller pressure can be outputted to the pilot pipe line 19. Accordingly, when the operation part 35 is operated and the current flowing in the solenoid coil 25 is made gradually larger, the pilot pressure oil supplied to a not shown operation valve can be gradually depressurized. Thereupon, since the pressure oil supplied to the hydraulic motor gradually decreases, a speed of a running vehicle can be gradually lowered, resulting in stopping the vehicle.

The operation part 35 sends a signal to the receiving part 36 by radio-transmission. However, the signal may be transmitted to the receiving part 36 by wire-communication.

In the following, arrangement modes of the above mentioned PPC valve 50 and the EPC valve 60 will be explained.

Figure 20:
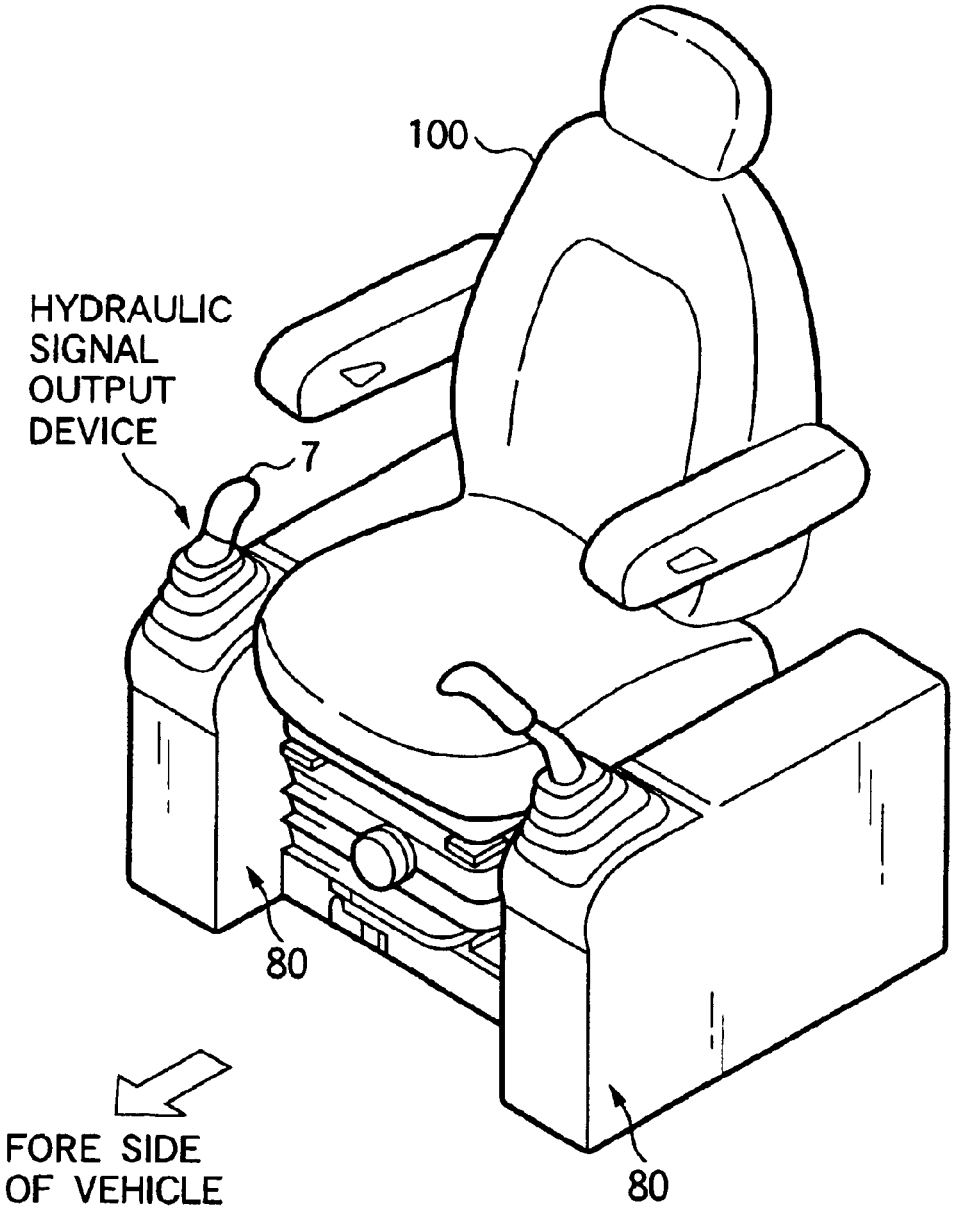
FIG. 20 is a diagram showing an operator's seat 100 disposed in an operation room.
Figure 21B:
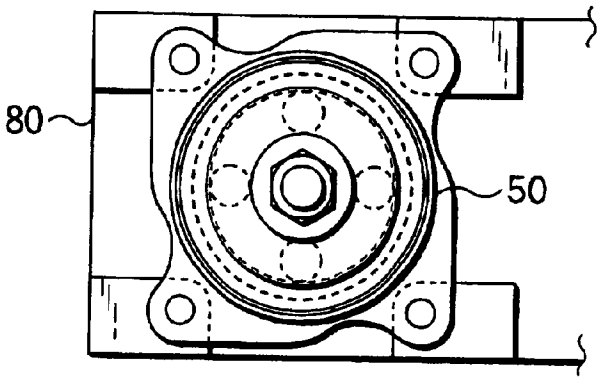
FIGS. 21A through 21C are a side view, a plan view and a bottom view of a hydraulic signal output device 50, respectively.
Figure 21C:
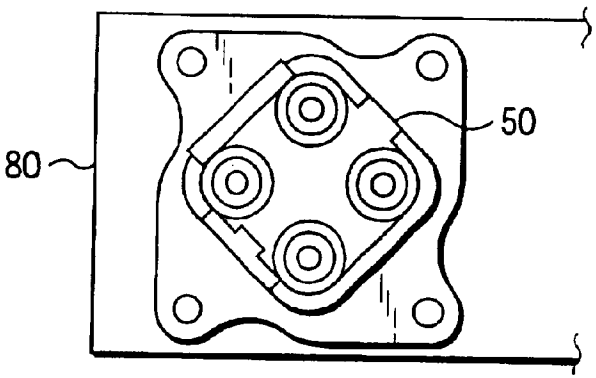
Figure 21A:
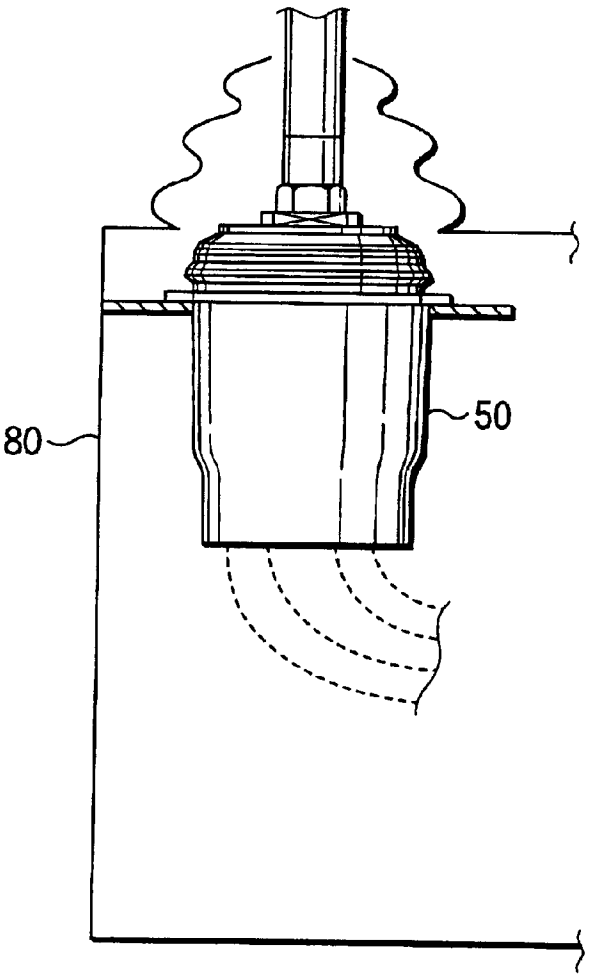

FIG. 20 shows an operator's seat 100 disposed in an operation room. At the sideward of the operator's seat 100, a lever stand 80 is arranged. The lever stand 80 is equipped with a hydraulic signal output device that is constituted of the PPC valve 50 and the EPC valve 60. To the hydraulic signal output device, an operation lever 7 is attached and disposed so as to project upward from the lever stand 80.

Since the operation lever 7 directly operates the PPC valve 50, there is necessity to dispose the PPC valve 50 above the lever stand 80. On the other hand, since the EPC valve 60 is remote-controlled, the EPC valve 60 can be arbitrarily disposed inside of the lever stand 80. Accordingly, in accordance with a shape of the lever stand 80, the EPC valve 60 can be placed at the most appropriate place. In the following, various implementation modes of the placement with respect to the EPC valve 60 will be explained.

The following explanation of an internal configuration of the hydraulic signal output device assumes the configuration of FIG. 1 (the first embodiment). However, the explanation can be similarly applied even to the configurations assuming FIG. 5 (the second embodiment), FIG. 7 (the third embodiment) and FIG. 9 (the fourth embodiment).

Figure 15B:
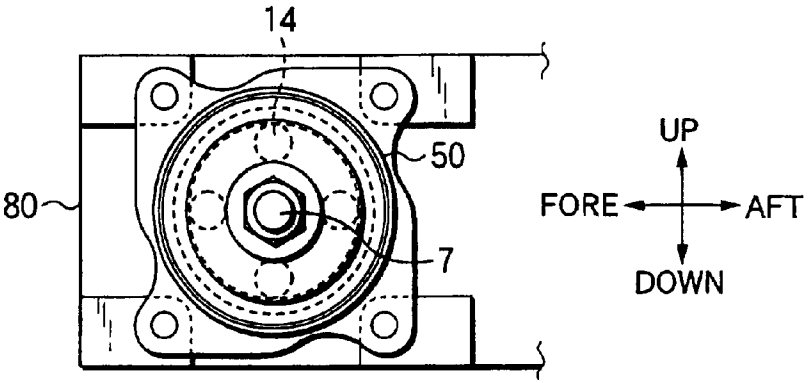
FIGS. 15A through 15C are a side view, a plan view and a bottom view of a hydraulic signal output device 90, respectively.
Figure 15C:
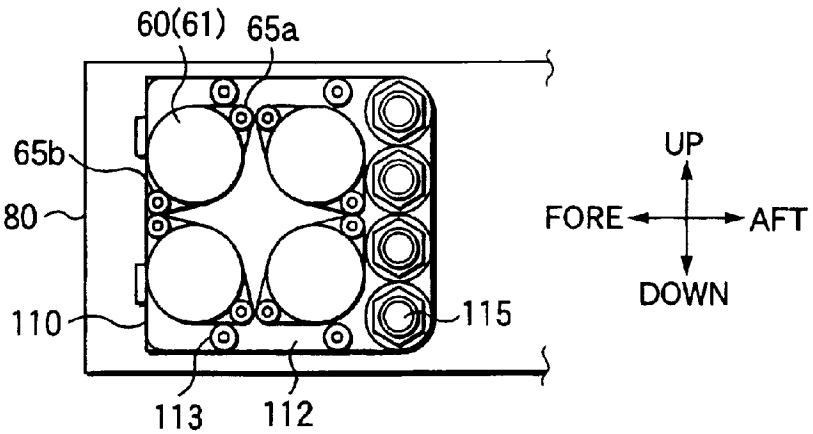
Figure 15A:
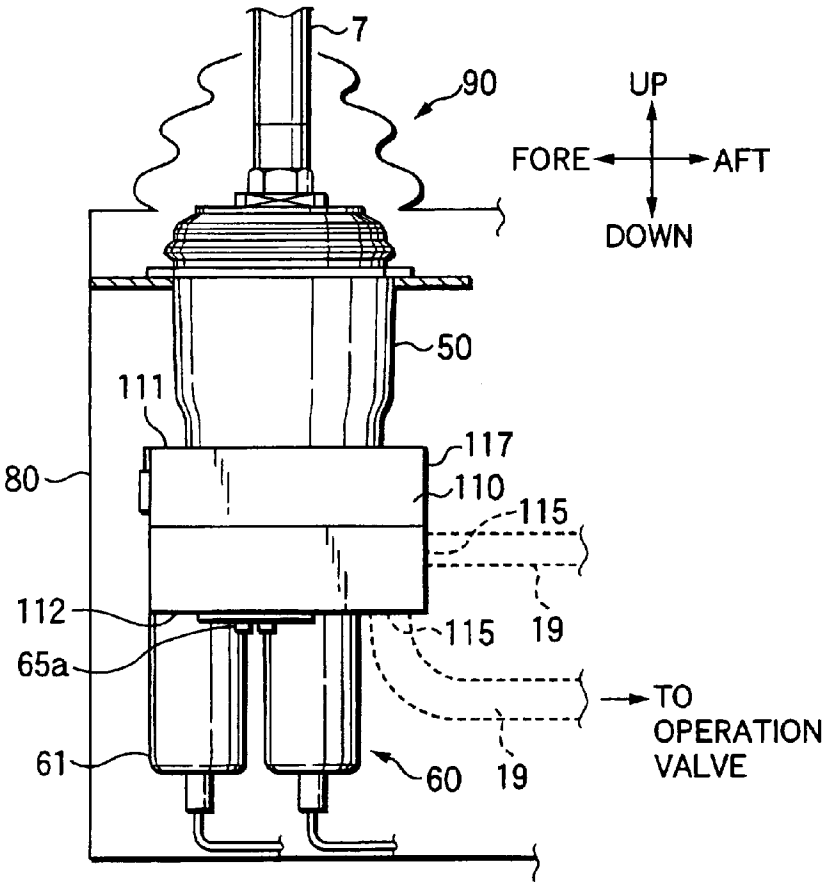

FIGS. 15A through 15C are drawings showing a fifth embodiment of the present invention, and show a side view, a plan view and a bottom view, respectively, of a hydraulic signal output device 90. FIG. 15A is a drawing of an operation room seen from a left side surface, FIG. 15B being a drawing when the operation room of FIG. 15A is seen from above, FIG. 15C being a drawing when the operation room of FIG. 15A is seen from below.

The hydraulic signal output device 90 is accommodated in a rectangular parallelepiped lever stand 80 that is long in an up and down direction. The hydraulic signal output device 90 includes the PPC valve 50, the block 110 and the EPC valve 60.

There is disposed the shuttle valve 30 in the block 110 as explained in FIG. 1.

The PPC valve 50 includes four pressure-reducing valves 14 as explained in FIG. 1, and in each of the pressure-reducing valves 14 a spool 15 is accommodated sliding-free. The PPC valve 50 is attached to a top surface of a top plate 111 of the block 110 so that the spool 15 therein may slide in an up and down direction.

On the other hand, as shown in FIG. 1, the EPC valve 60 includes the electromagnetic solenoid 61 and the pressure-reducing valve 27. In the present embodiment, corresponding to the four pressure-reducing valves 14, four EPC valves 60 are disposed. In the electromagnetic solenoid 61, as shown in FIG. 1, the plunger 26 that is actuated according to the electrical signal is accommodated sliding-free.

The electromagnetic solenoid 61 that constitutes the EPC valve 60 is attached to a bottom surface of a bottom plate 112 of the block 110 so that the plunger 26 therein may slide in an up and down direction. Thus, the EPC valve 60 is placed downward from the PPC valve 50 so that the spool 15 and the plunger 26 may be in a parallel relationship, and the PPC valve 50 and the EPC valve 60 are integrally formed.

Accordingly, according to the present fifth embodiment, since the PPC valve 50 and the EPC valve 60 are integrally formed along an up and down direction so that the spool 15 and the plunger 26 may be in parallel, the hydraulic signal output device 90 itself can be formed longer in an up and down direction and smaller in a lateral direction. Accordingly, even when the lever stand 80 is smaller in a lateral direction, the hydraulic signal output device 90 can be accommodated inside of the lever stand 80.

In the present embodiment, as shown in FIGS. 15A and 15C, in the block 110 of the hydraulic signal output device 90, an output port 115 for externally outputting a hydraulic signal is formed. In accordance with the hydraulic signal outputted from the output port 115, an operation valve is operated. The operation valve is disposed behind the lever stand 80. The output port 115 and the operation valve are connected with a pipe line 19 (shown with a dashed line).

The output port 115 is disposed backward on a bottom surface of a bottom plate 112 of the block 110. That is, the output port 115 is disposed toward the operation valve side of various positions on the block 110.

Thus, in the present embodiment, the output port 115 is disposed on a side facing a place where the operation valve is disposed. Accordingly, when the pipe line 19 is routed, the output port can be connected to the operation valve at the shortest distance, and there is no need of circumventing obstacles such as the electromagnetic solenoid 61 and so on disposed on the bottom plate 112 of the block 110. As a result, since the pipe line 19 can be efficiently routed, the pipe line can be easily configured.

In the present embodiment, the output port 115 is disposed backward on the bottom plate 112 of the block 110. However, as shown in FIG. 15A, the output port 115 may be disposed on a side plate 117 behind the block 110 and the pipe line 19 (shown with a chain line) may be routed to the operation valve at the backward.

In the present embodiment, as shown in FIG. 15C, four EPC valves 60 are disposed in parallel with an inner wall surface of the lever stand 80.

Accordingly, according to the present embodiment, even when the lever stand 80 is small in a width, the hydraulic signal output device 90 can be accommodated inside of the lever stand 80.

In the present embodiment, as shown in FIG. 15C, on the bottom plate 112 of the block 110, in close proximity to the EPC valve 60 a bolt 113 is disposed for fixing other member. On the other hand, when the electromagnetic solenoid 61 of the EPC valve 60 is fixed onto the bottom plate 112 of the block 110 of the hydraulic signal output device 90, two bolts 65*a* and 65*b* are used.

Figure 16:
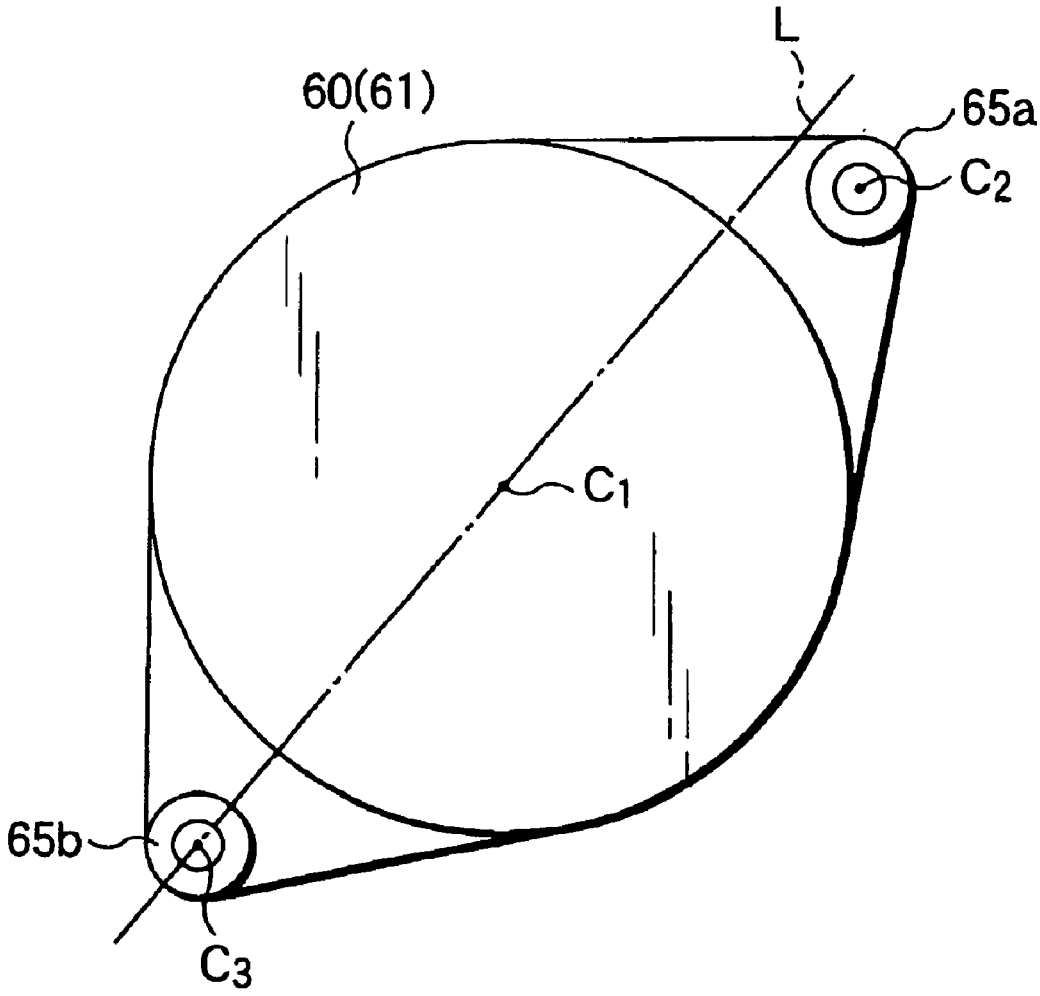
FIG. 16 is a diagram showing a positional relationship between the EPC valve 60 and bolts 65*a*, 65*b*.

In order for the bolt 113 not to interfere with the bolts 65*a* and 65*b*, in an arrangement mode as shown in FIG. 16, the bolts 65*a* and 65*b* are arranged. That is, when the electromagnetic solenoid 61 of the EPC valve 60 is fixed, on an axis L along a diameter direction of the EPC valve 60, that is, on an axis L going through a center C1 of the EPC valve 60, one bolt 65*b* is disposed, and the other bolt 65*a* is disposed off-set from the axis L.

As a result, an existing bolt 113 and the bolt 65*a* for use in attachment of the EPC valve are hindered from interfering.

Figure 17B:
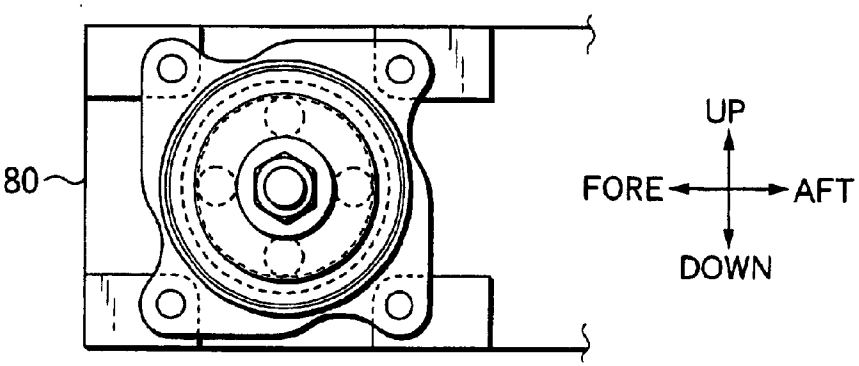
FIGS. 17A through 17C are a side view, a plan view and a bottom view of a hydraulic signal output device 91, respectively.
Figure 17C:
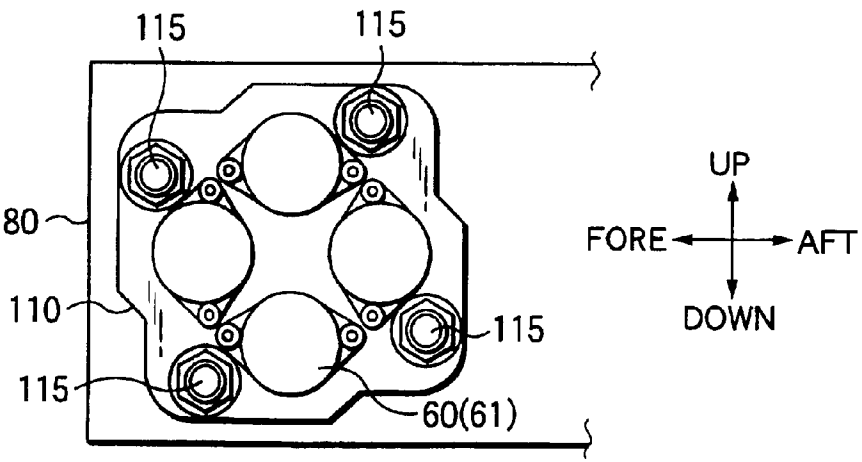
Figure 17A:
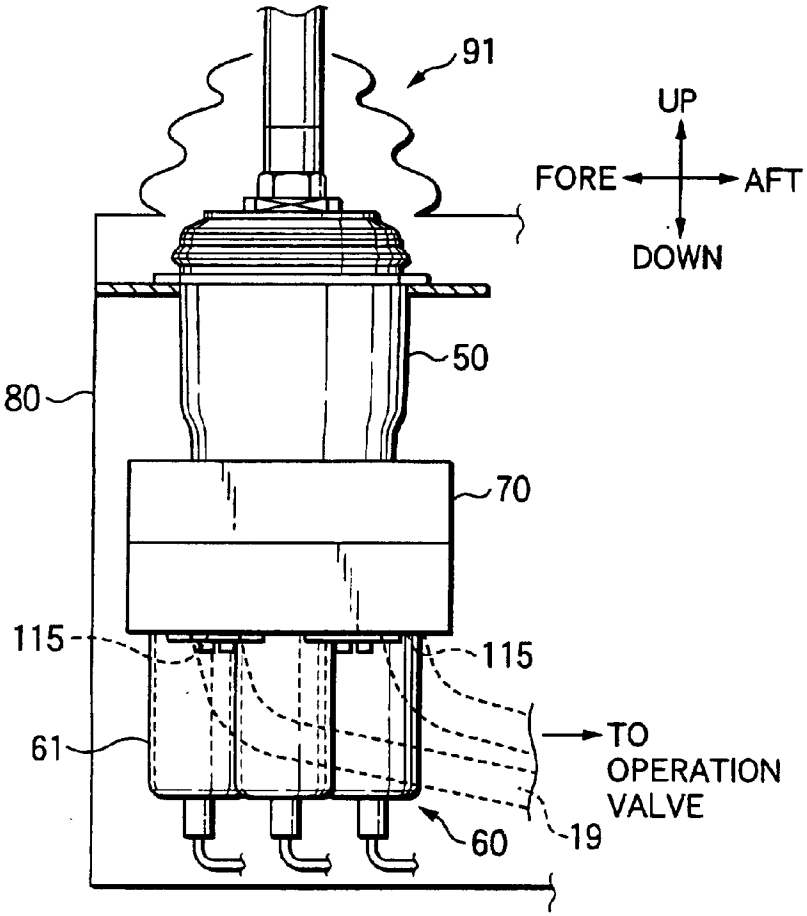

FIG. 17 shows a sixth embodiment that is a modification of the fifth embodiment. FIGS. 17A through 17C correspond to FIGS. 15A through 15C and show a side view, a plan view, and a bottom view, respectively, of a hydraulic signal output device 91 according to the sixth embodiment.

Four EPC valves 60 that constitute the hydraulic signal output device 91, as shown in FIG. 17C, are disposed at a position that is rotated by 45 degree with respect to the positional relationship shown in FIG. 15C. That is, an arrangement direction of adjacent EPC valves 60 is at 45 degree with respect to an inner wall surface of the lever stand 80 and is not in parallel with the inner wall surface different from FIG. 15C.

Figure 18B:
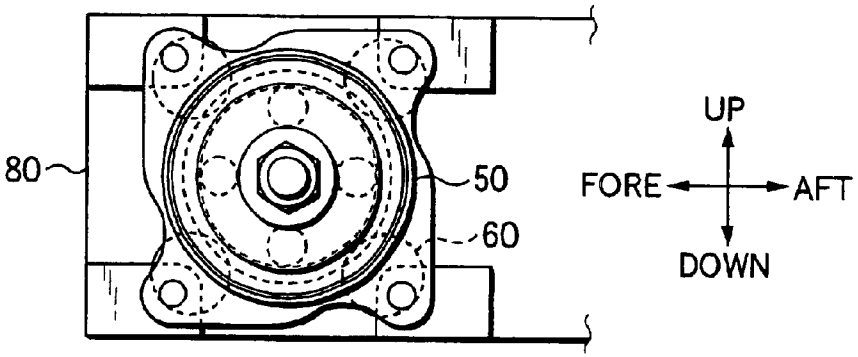
FIGS. 18A through 18C are a side view, a plan view and a bottom view of a hydraulic signal output device 92, respectively.
Figure 18C:
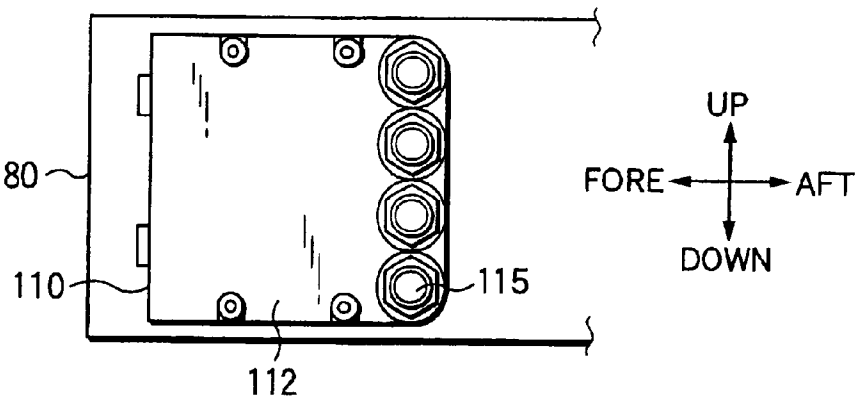
Figure 18A:
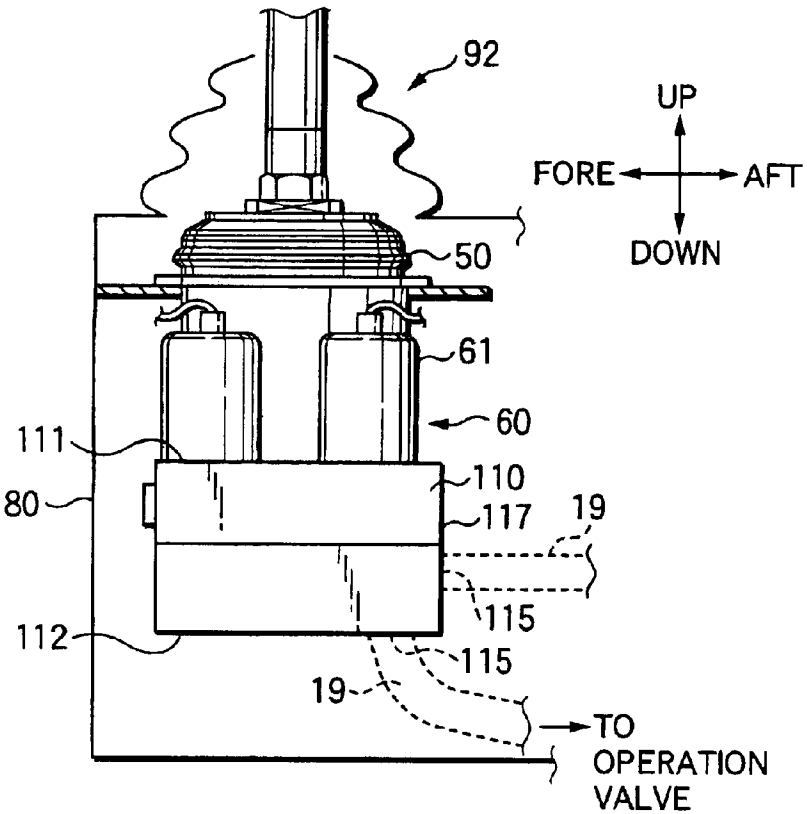

FIGS. 18A through 18C show a seventh embodiment, correspond to FIGS. 15A through 15C and show a side view, a plan view and a bottom view, respectively, of the hydraulic signal output device 92 according to the seventh embodiment.

In the present embodiment, as shown in FIGS. 18A and 18B, the PPC valve 50 is attached to a top surface of the top plate 111 of the block 110 so that the spool 15 (FIG. 1) inside of the PPC valve 50 may slide in an up and down direction. On the other hand, the electromagnetic solenoid 61 that constitutes the EPC valve 60 is attached to a top surface of the top plate 111 of the block 110 so that the plunger 26 (FIG. 1) therein may slide in an up and down direction. Thus, the electromagnetic solenoid 61 that constitutes the EPC valve 60 is disposed at a height substantially same as the PPC valve 50 so that the spool 15 and the plunger 26 may be in parallel, and the PPC valve 50 and the EPC valve 60 are integrally formed.

According to the present embodiment, the electromagnetic solenoid 61 that constitutes the EPC valve 60 is disposed at a height substantially same as the PPC valve 50 so that the spool 15 and the plunger 26 may be in parallel, and the PPC valve 50 and the EPC valve 60 are integrally formed. Accordingly, the hydraulic signal output device 92 itself can be formed shorter in an up and down direction. As a result, even when the lever stand 80 is lower in height, the hydraulic signal output device 92 can be accommodated in the lever stand 80.

In the present embodiment, the electromagnetic solenoid 61 is disposed at a height substantially same as the PPC valve 50. However, an entirety of the EPC valve 60, that is, the electromagnetic solenoid 61 and the pressure-reducing valve 27 (FIG. 1), may be disposed at a height substantially same as the PPC valve 50.

Furthermore, in the present embodiment, similarly to the fifth embodiment shown in FIG. 15, the output port 115 is disposed backward on the bottom surface of the bottom plate 112 of the block 110. That is, the output port 115 is disposed toward the operation valve side of various places of the block 110 (FIGS. 18A and 18C).

Thus, in the present embodiment, since the output port 115 is disposed on a side that faces an arrangement position of the operation valve, of various positions of the block 110, when the pipe line 19 is routed, the output port 115 can be connected to the operation valve at the shortest distance. Accordingly, the pipe line can be efficiently routed, resulting in an easy pipe line configuration.

In the present embodiment, the output port 115 is disposed backward on the bottom plate 112 of the block 110. However, as shown in FIG. 18A, the output port 115 may be disposed on a side plate 117 behind the block 110, and the pipe line 19 (shown with a chain line) may be routed to the backward operation valve.

Figure 19B:
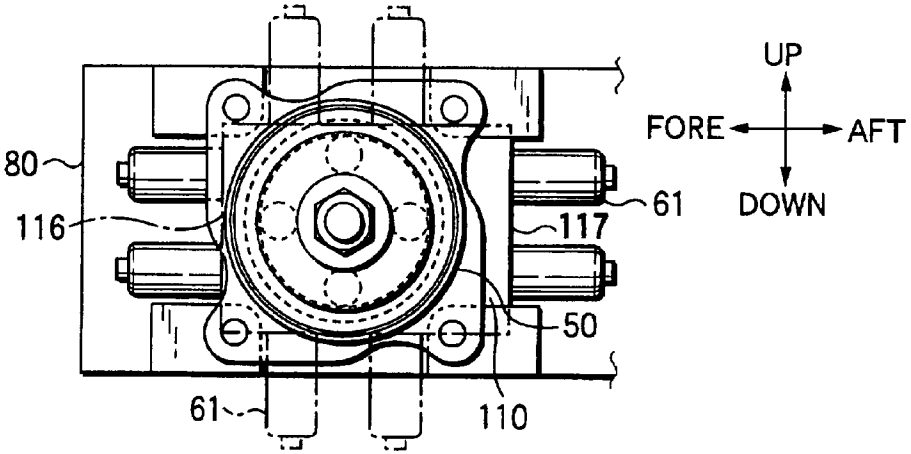
FIGS. 19A through 19C are a side view, a plan view and a bottom view of a hydraulic signal output device 93, respectively.
Figure 19C:
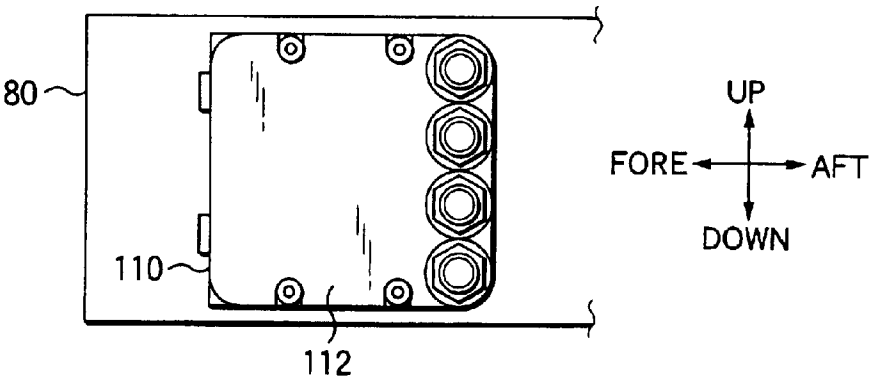
Figure 19A:
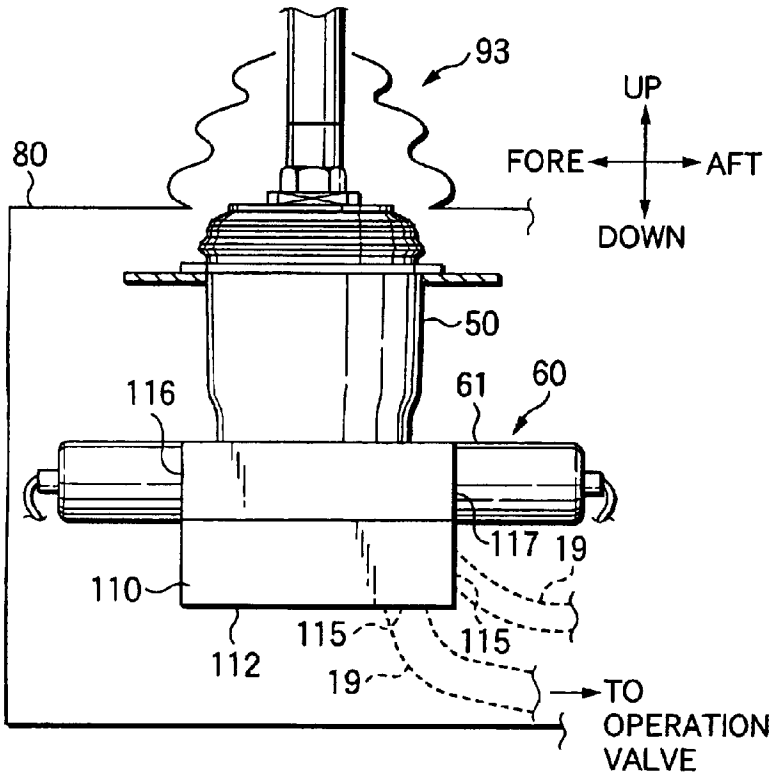

FIGS. 19A through 19C show an eighth embodiment, correspond to FIGS. 15A through 15C, and are a side view, a plan view and a bottom view, respectively, of a hydraulic signal output device 93 according to the eighth embodiment.

In the present embodiment, as shown in FIGS. 19A and 19B, the PPC valve 50 is attached to a top surface of the top plate 111 of the block 110 so that the spool 15 (FIG. 1) inside of the PPC valve 50 may slide in an up and down direction. On the other hand, the electromagnetic solenoids 61 that constitute the EPC valve 60 are attached to side surfaces of side plates 116 and 117 of the block 110 so that the plunger 26 (FIG. 1) therein may slide in a fore and aft direction. Thus, the PPC valve 50 and the EPC valve 60 are integrally formed so that the plunger 26 may be in a perpendicular relation with respect to the spool 15.

According to the present embodiment, since the PPC valve 50 and the EPC valve 60 are integrally formed so that the plunger 26 may be in a perpendicular relation with respect to the spool 15, the hydraulic signal output device 93 can be made larger in a width and shorter in an up and down direction. Accordingly, the hydraulic signal output device 93 can be accommodated in the lever stand 80 that is lower in height but larger in width.

In the present embodiment, as shown in FIG. 19B, the electromagnetic solenoid 61 is attached to the block 110 so that the plunger 26 therein may slide in a fore and aft direction. However, as shown with a dashed line, the electromagnetic solenoid 61 may be attached to the block 110 so that the plunger 26 therein may slide from side to side.

In the present embodiment, the electromagnetic solenoid 61 is disposed sideward to the PPC valve 50. However, an entirety of the PPC valve 60, that is, the electromagnetic solenoid 61 and the pressure-reducing valve 27 (FIG. 1) may be disposed sideward to the PPC valve 50.

Furthermore, in the present embodiment, similarly to the fifth embodiment shown in FIG. 15, the output port 115 is disposed backward on the bottom surface of the bottom plate 112 of the block 110. That is, the output port 115 is disposed toward the operation valve side of various positions of the block 110. (FIG. 19A, 19B)

Thus, in the present embodiment, since the output port 115 is disposed on a side that faces a position where the operation valve is disposed, of various positions of the block 110, when the pipe line 19 is routed, the output port 115 can be connected to the operation valve at the shortest distance. Accordingly, the pipe line can be efficiently routed, resulting in an easy pipe line configuration.

In the present embodiment, the output port 115 is disposed behind the bottom plate 112 of the block 110. However, as shown in FIG. 19A, the output port 115 may be disposed on a side plate 117 at the backward of the block 110, and the pipe line 19 (shown with a dashed line) may be routed to the operation valve at the backward.

What is claimed is:

1. A hydraulic signal output device, including:

manual hydraulic signal output means for outputting a hydraulic signal into an opening of a switching valve based on a manual operation;

electrical hydraulic signal output means for outputting a hydraulic signal into another opening of a switching valve based on an electrical signal; and selection output means for selecting and externally outputting either the hydraulic signal outputted from the manual hydraulic signal output means or the hydraulic signal outputted from the electrical hydraulic signal output means into a pipeline from the switching valve;

wherein the manual hydraulic signal output means, the electrical hydraulic signal output means and the selection output means are integrally formed.

2. A hydraulic signal output device provided with manual hydraulic signal output means that manually output a hydraulic signal from a signal output port and externally output the hydraulic signal through a pipe line, including:

an electromagnetic valve in which a hydraulic signal is inputted and an oil passage is opened/closed according to an electrical signal generated by a remote-operation;

wherein an inlet of the electromagnetic valve is integrally formed with the signal output port and an outlet of the electromagnetic valve is connected to the pipe line; and the electromagnetic valve is opened to externally output a hydraulic signal outputted from the signal output port through the pipe line, and in accordance with a communication release instruction due to the remote-operation the electromagnetic valve is closed to cut off the hydraulic signal outputted from the signal output port with the electromagnetic valve.

3. A hydraulic signal output device as set forth in claim 2:

wherein the manual hydraulic signal output means and the electromagnetic valve are integrally formed.

4. A hydraulic signal output device provided with manual hydraulic signal output means that manually output a hydraulic signal from a signal output port and externally output the hydraulic signal through a pipe line, including:

electrical hydraulic signal output means in which a hydraulic signal is inputted, converted into a hydraulic signal in accordance with an electrical signal generated by the remote-operation and outputted, the electrical hydraulic signal output means and the manual hydraulic signal output means being intergrally formed;

wherein the signal output port and an inlet of the electrical hydraulic signal output means are connected, and an outlet of the electrical hydraulic signal output means is connected to the pipe line; and the electrical hydraulic signal output means are operated in accordance with a hydraulic signal change instruction due to the remote-operation to modify a hydraulic signal outputted from the signal output port and to externally output a depressurized signal through the pipe line.

5. A hydraulic signal output device, including:

a manual part that has a manual spool that is manually operated and outputs a hydraulic signal in accordance with the operation of the manual spool; and a motorized part that has a motorized shaft that is operated with an electrical signal and outputs a hydraulic signal in accordance with the operation of the motorized shaft;

wherein the motorized part is disposed below the manual part so that the manual spool and the motorized shaft are arranged in parallel; and the manual part and the motorized part are integrally formed.

6. A hydraulic signal output device as set forth in claim 5:

wherein a block of the hydraulic signal output device is provided with an output port that externally outputs a hydraulic signal and an operation valve that is operated in accordance with a hydraulic signal that is outputted from the output port; and of various positions of the block, on a side that faces a position where the operation valve is disposed, the output port is disposed.

7. A hydraulic signal output device as set forth in claim 5:

wherein the motorized part includes a plurality of electromagnetic valves; and a stand for accommodating the motorized part is provided;

wherein the plurality of electromagnetic valves are arranged so that a direction of arrangement of the plurality of electromagnetic valves is in parallel with an internal wall surface of the stand.

8. A hydraulic signal output device including:

a manual part that has a manual spool that is manually operated and outputs a hydraulic signal in accordance with the operation of the manual spool; and a motorized part that has a motorized shaft that is operated with an electrical signal and outputs a hydraulic signal in accordance with the operation of the motorized shaft;

wherein the motorized part is disposed below the manual part so that the manual spool and the motorized shaft may be in parallel;

the manual part and the motorized part are integrally formed;

the motorized part includes a plurality of electromagnetic valves; and when each of the electromagnetic valves is fixed to the block of the hydraulic signal output device by use of a plurality of bolts, at least one bolt is disposed on an axis (L) along a diameter direction of the electromagnetic valve and a remaining bolt is disposed off-set from the axis (L).

9. A hydraulic signal output device, including:

a manual part that has a manual spool that is manually operated and outputs a hydraulic signal in accordance with the operation of the manual spool; and a motorized part that has a motorized shaft that is operated by an electrical signal and outputs a hydraulic signal in accordance with the operation of the motorized shaft;

wherein the motorized part is partially or entirely disposed at a height substantially equal to the manual part so that the manual spool and the motorized shaft are arranged in parallel; and the manual part and the motorized part are integrally formed.

10. A hydraulic signal output device as set forth in claim 9:

wherein the motorized part has an electromagnetic solenoid, and the motorized shaft is a plunger of the electromagnetic solenoid;

wherein the electromagnetic solenoid is disposed at a height substantially same as the manual part so that the manual spool and the motorized shaft are in parallel.

11. A hydraulic signal output device, including:

a manual part that has a manual spool that is operated manually and outputs a hydraulic signal in accordance with the operation of the manual spool; and a motorized part that has a motorized shaft that is operated by an electrical signal and outputs a hydraulic signal in accordance with the operation of the motorized shaft;

wherein the manual part and the motorized part are integrally formed so that the motorized shaft is positioned perpendicularly to the manual spool.

12. A hydraulic signal output device as set forth in claim 11:

wherein the motorized part has an electromagnetic solenoid, and the motorized shaft is a plunger of the electromagnetic solenoid;

wherein the electromagnetic solenoid is disposed sideward with respect to the manual part so that the motorized shaft is positioned perpendicularly to the manual spool.

* * * * *